US011097408B2

(12) United States Patent
Akiba

(10) Patent No.: US 11,097,408 B2
(45) Date of Patent: Aug. 24, 2021

(54) DRIVING TOOL

(71) Applicant: MAKITA CORPORATION, Anjo (JP)

(72) Inventor: Yoshitaka Akiba, Anjo (JP)

(73) Assignee: MAKITA CORPORATION, Anjo (JP)

( * ) Notice: Subject to any disclaimer, the term of this patent is extended or adjusted under 35 U.S.C. 154(b) by 86 days.

(21) Appl. No.: 16/525,497

(22) Filed: Jul. 29, 2019

(65) Prior Publication Data

US 2020/0039044 A1 Feb. 6, 2020

(30) Foreign Application Priority Data

Aug. 1, 2018 (JP) ..... JP2018-145459

(51) Int. Cl.
*B25C 1/06* (2006.01)

(52) U.S. Cl.
CPC ..... *B25C 1/06* (2013.01)

(58) Field of Classification Search
CPC ..... B25C 1/06
USPC ..... 227/2, 7, 129, 107–155
See application file for complete search history.

(56) References Cited

U.S. PATENT DOCUMENTS 5,511,715 A * 4/1996 Crutcher ..... B25C 1/06 227/131
6,796,475 B2 * 9/2004 Adams ..... B25C 1/06 227/129
7,646,157 B2 1/2010 Cruise et al.
2002/0185514 A1 * 12/2002 Adams ..... B25C 1/008 227/2
2010/0038394 A1 * 2/2010 Hlinka ..... B25C 1/06 227/2
2011/0132959 A1 * 6/2011 Hlinka ..... B25C 1/008 227/8
2015/0306753 A1 * 10/2015 Po ..... B25C 1/06 227/109
2016/0207185 A1 * 7/2016 Garber ..... B25C 1/008
2020/0030954 A1 * 1/2020 Wolf ..... B25C 1/06
2021/0138622 A1 * 5/2021 Enta ..... B25C 1/047

* cited by examiner

*Primary Examiner* — Anna K Kinsaul
*Assistant Examiner* — Himchan Song
(74) *Attorney, Agent, or Firm* — Oliff PLC

(57) ABSTRACT

A driving tool includes a motor, a flywheel, a driver and a control part. The driver is disposed to face an outer periphery of the flywheel and configured to perform a driving operation of driving the fastener into the workpiece by moving along an operation line, by rotational energy transmitted from the flywheel. The control part is configured to control driving of the motor. The control part is configured to set rotation speed of the motor based on first information and second information. The first information corresponds to rotational energy of the flywheel before the driving operation of the driver. The second information corresponds to rotational energy of the flywheel after the driving operation of the driver.

12 Claims, 14 Drawing Sheets

FIG. 8

187

| N1 (rpm) | N2 (rpm) | N (rpm) |
|---|---|---|
| 12,000 | ~7,000 | 12,000 |
| | 7,000 ~ 8,000 | 11,000 |
| | 8,000 ~ 9,000 | 10,000 |
| | 9,000 ~ 10,000 | 9,000 |
| | 10,000~ | 8,000 |
| 11,000 | ~5,000 | 12,000 |
| | 5,000 ~ 7,000 | 11,000 |
| | 7,000 ~ 8,000 | 10,000 |
| | 8,000 ~ 9,000 | 9,000 |
| | 9,000~ | 8,000 |
| 10,000 | ~4,000 | 12,000 |
| | 4,000 ~ 5,000 | 11,000 |
| | 5,000 ~ 7,000 | 10,000 |
| | 7,000 ~ 8,000 | 9,000 |
| | 8,000~ | 8,000 |
| ⋮ | ⋮ | ⋮ |
| 8,000 | ~3,000 | 10,000 |
| | 3,000 ~ 4,000 | 9,000 |
| | 4,000~ | 8,000 |

DRIVING TOOL

CROSS-REFERENCE TO RELATED APPLICATION

The present application claims priority to Japanese patent application No. 2018-145459 filed on Aug. 1, 2018, the contents of which are fully incorporated herein by reference.

TECHNICAL FIELD

The present disclosure relates to a driving tool that is configured to drive a fastener into a workpiece with a driver.

BACKGROUND ART

A driving tool is known which is configured to drive a fastener such as a nail into a workpiece by linearly moving a driver. For example, U.S. Pat. No. 7,646,157 discloses a driving tool which includes a power source including a motor and a flywheel, a driver, a follower for frictionally engaging the driver with the flywheel, an actuator for driving the follower, and a control part for selectively actuating the motor and the actuator. In this driving tool, the control part is configured to control supply of electric power to the power source such that the flywheel rotates at a specified speed, based on rotation speed of one element of the power source which is detected by a speed sensor.

SUMMARY

Kinetic energy (rotational energy) stored in the flywheel by rotation is proportional to the moment of inertial and to the square of the angular velocity of the flywheel. Therefore, when the rotation speed of the flywheel is controlled to a constant speed like in the driving tool of U.S. Pat. No. 7,646,157, the kinetic energy of the flywheel also becomes constant. On the other hand, kinetic energy required for the driver to drive a fastener in an optimum state may vary, depending on the fastener and a workpiece into which the fastener is driven. Therefore, in the driving tool of U.S. Pat. No. 7,646,157, excessive output or insufficient driving may be caused.

Accordingly, it is an object of the present disclosure to provide a driving tool which is capable of properly controlling rotational energy for driving a fastener.

According to one aspect of the present disclosure, a driving tool is provided which is configured to eject a fastener from an outlet to drive the fastener into a workpiece. This driving tool includes a motor, a flywheel, a driver and a control part.

The flywheel is configured to be rotationally driven by the motor. The driver is disposed to face an outer periphery of the flywheel, and configured to perform a driving operation by rotational energy transmitted from the flywheel. The driving operation refers to an operation of driving the fastener into the workpiece by moving along an operation line. The control part is configured to control driving of the motor. Further, the control part is configured to set rotation speed of the motor based on first information and second information. The first information refers to information which corresponds to rotational energy of the flywheel before the driving operation of the driver, and the second information refers to information which corresponds to rotational energy of the flywheel after the driving operation of the driver.

It is noted that the first and second information may be the rotational energy of the flywheel itself or a physical quantity having a predetermined correlation with the rotational energy of the flywheel. Examples of the physical quantity may include rotation speed of the motor and rotation speed of the flywheel.

In one aspect of the present disclosure, the control part may be configured to set the rotation speed of the motor with reference to correspondences between the first information, the second information and the rotation speed of the motor which are preset and stored in a storage part. The correspondences may be typically embodied by a table or a database in which the first information, the second information and the rotation speed are associated with each other and stored.

In one aspect of the present disclosure, the first information, the second information and the rotation speed of the motor may be associated with each other and stored in a table in advance, and the table may be stored in the storage part. Further, the control part may be configured to set the rotation speed with reference to the table.

In one aspect of the present disclosure, the driving tool may further include a first sensor configured to detect rotation speed of the motor or the flywheel. In this case, the first information may be rotation speed of the motor or the flywheel which is detected by the first sensor before the driving operation, and the second information may be rotation speed of the motor or the flywheel which is detected by the first sensor after the driving operation. It is noted that the first sensor may directly or indirectly detect the rotation speed of the motor or the flywheel.

In one aspect of the present disclosure, the motor may be a brushless motor. Further, the first sensor may include a Hall sensor which is configured to detect a rotation position of the motor.

In one aspect of the present disclosure, the control part may be configured to set the rotation speed of the motor to a maximum value within a settable range in a case where the rotation speed of the motor or the flywheel which is detected after the driving operation is smaller than a specified threshold.

In one aspect of the present disclosure, the control part may be configured to set the rotation speed of the motor to a maximum value within a settable range in a case where a specified time elapses without a next driving operation being performed after a driving operation.

In one aspect of the present disclosure, the driving tool may further include a second sensor which is configured to detect information corresponding to movement of the driving tool which is caused by the driving operation. The control part may be configured to set the rotation speed of the motor based on a detection result of the second sensor.

In one aspect of the present disclosure, the second sensor may be provided in a tool body which houses at least the motor and the flywheel, or in a handle connected to the tool body.

In one aspect of the present disclosure, the second sensor may be an acceleration sensor. The control part may be configured to set the rotation speed of the motor to a maximum value within a settable range in a case where the acceleration exceeds a specified threshold.

In one aspect of the present disclosure, the driving tool may further include an indication part which is configured to indicate information relating to a condition of driving the motor by the controller.

In one aspect of the present disclosure, the driving tool may further include a battery mounting part which is configured to removably receive a rechargeable battery.

BRIEF DESCRIPTION OF THE DRAWINGS

FIG. 8 is a table showing correspondences between rotation speed of a motor before driving operation, a range of the rotation speed of the motor after driving operation and the rotation speed of the motor for the next driving operation.

DETAILED DESCRIPTION OF THE EMBODIMENTS

An embodiment is now described with reference to the drawings. In the present embodiment, a nailing machine 1 is described as an example of a driving tool. The nailing machine 1 is a tool which is capable of driving a nail 101, which is an example of a fastener, into a workpiece (such as wood) 100 by linearly driving out the nail 101.

Figure 1:
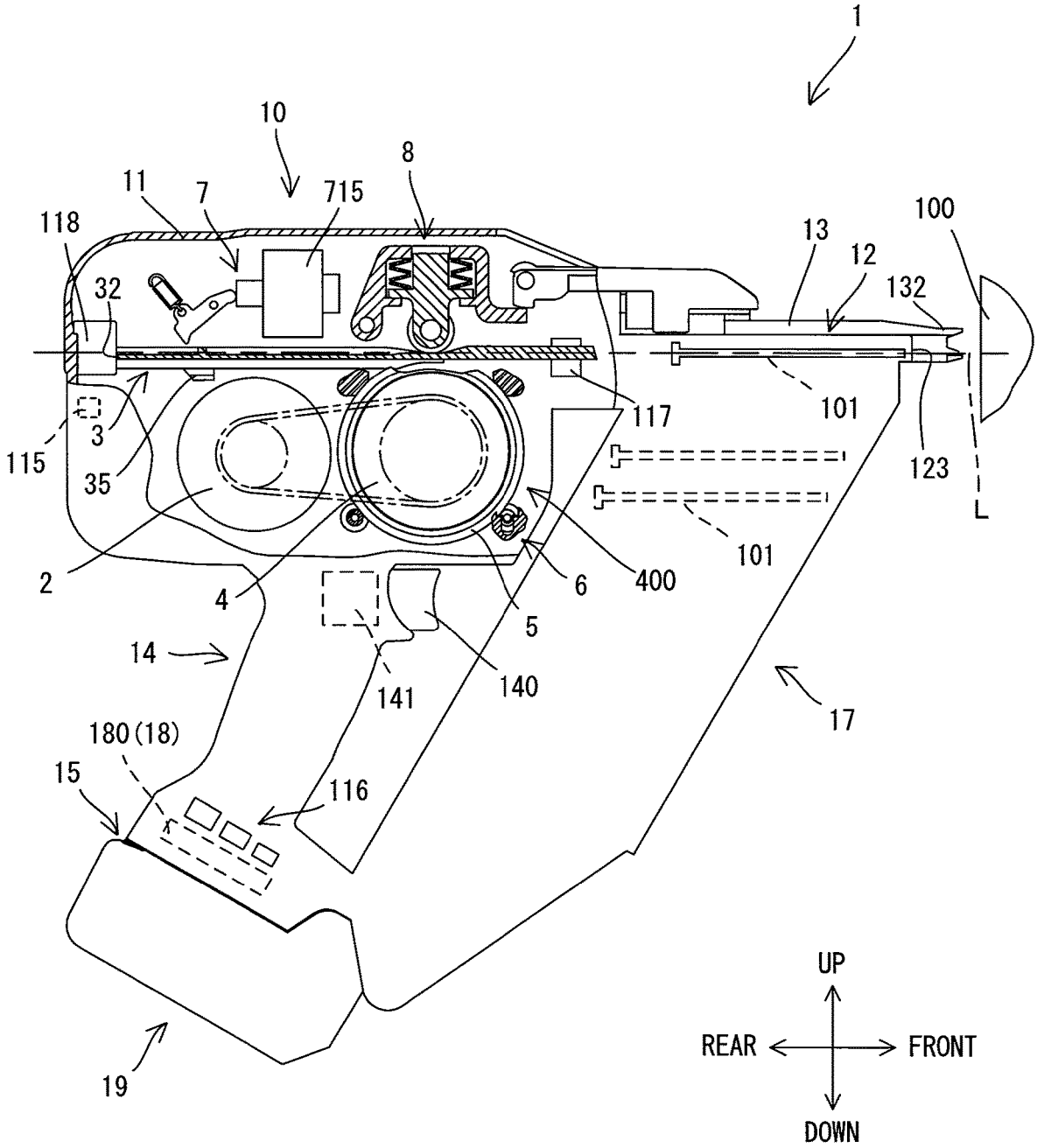
FIG. 1 is an explanatory drawing for schematically showing an overall structure of a nailing machine when a driver is placed in an initial position.

First, the general structure of the nailing machine 1 is described with reference to FIG. 1. As shown in FIG. 1, an outer shell of the nailing machine 1 is mainly formed by a tool body 10, a handle 14 and a magazine 17.

The tool body 10 includes a body housing 11 and a nose part 12. The body housing 11 houses a motor 2, a driver 3 and a driver-driving mechanism 400. The driver 3 is disposed to be movable along a specified operation line L. The driver-driving mechanism 400 is configured to drive out the nail 101 from the nailing machine 1 by linearly moving the driver 3 along the operation line L. The nose part 12 is connected to one end of the body housing 11 in an extending direction of the operation line L (hereinafter simply referred to as an operation-line-L direction). The nose part 12 has an outlet 123, through which the nail 101 is driven out, at the other end portion which is on the side opposite to the body housing 11. Further, a contact arm 13 is disposed on the nose part 12 so as to be movable in the operation-line-L direction. A contact arm switch 131 (see FIG. 7) is disposed within the body housing 11. The contact arm switch 131 is configured to be normally held in an off-state and to be turned on when the contact arm 13 is pressed.

The handle 14 extends in a direction crossing the operation line L, from a central portion of the body housing 11 in the operation-line-L direction. The handle 14 is configured to be held by a user. A trigger 140, which is configured to be depressed (pulled) by a user, is provided in a base end portion (an end portion connected to the body housing 11) of the handle 14. A trigger switch 141 is disposed within the handle 14. The trigger switch 141 is configured to be normally held in an off-state and to be turned on when the trigger 140 is depressed. Further, a battery mounting part 15 having terminals is provided on a leading end portion (an end portion opposite to the base end portion) of the handle 13. A rechargeable battery 19 may be removably mounted to the battery mounting part 15.

The magazine 17 is configured to be loaded with a plurality of nails 101 and mounted to the nose part 12. The nails 101 loaded in the magazine 17 may be fed one by one onto a travel path of the driver 3 by a nail-feeding mechanism (not shown). The structure of the magazine 17 is well known and therefore its description is omitted.

In the present embodiment, the nailing machine 1 is configured to start an operation of driving the nail 101 into the workpiece 100 with the driver 3 (hereinafter referred to as a driving operation) when both the contact arm switch 131 and the trigger switch 141 are turned on by a user. In other words, the driving operation is performed in response to user's operations of pressing the contact arm 13 against the workpiece 100 and depressing the trigger 140. The order of performing these two operations is not particularly limited.

The detailed structure of the nailing machine 1 is now described. In the following description, for convenience sake, the operation-line-L direction (right-left direction in FIG. 1) is defined as a front-rear direction of the nailing machine 1, and in the front-rear direction, the outlet 123 side (right side as viewed in FIG. 1) is defined as a front side of the nailing machine 1, while its opposite side (left side as viewed in FIG. 1) is defined as a rear side. Further, a direction (up-down direction as viewed in FIG. 1) which is orthogonal to the operation-line-L direction and which corresponds to the extending direction of the handle 14 is defined as an up-down direction of the nailing machine 1, and in the up-down direction, the side of the base end portion (upper side as viewed in FIG. 1) of the handle 14 is defined as an upper side, while the side of the leading end portion (lower side as viewed in FIG. 1) of the handle 14 is defined as a lower side. Further, a direction which is orthogonal to the front-rear direction and to the up-down direction is defined as a right-left direction.

First, the internal configuration of the tool body 10 is described.

Figure 2:
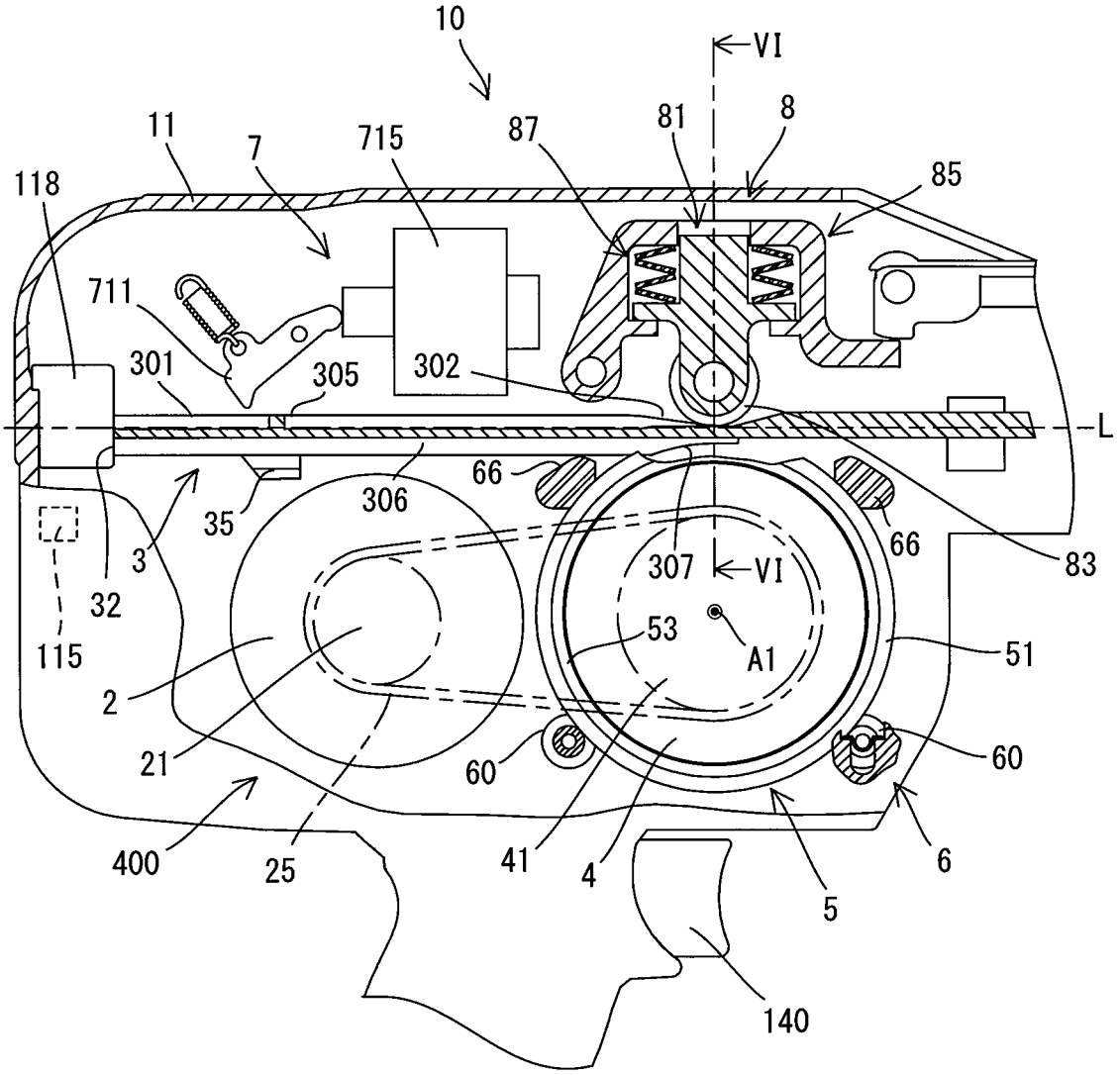
FIG. 2 is a partial, enlarged view of FIG. 1.

The internal configuration of the body housing 11 is first described. As shown in FIG. 2, the motor 2, the driver 3, the driver-driving mechanism 400 and an acceleration sensor 115 are disposed within the body housing 11. These structures are now described in this order.

As shown in FIG. 2, the motor 2 is housed in a lower rear portion of the body housing 11. Further, the motor 2 is disposed such that a rotation axis of an output shaft (not shown) extends in the right-left direction. In the present embodiment, a brushless direct current (DC) motor is employed as the motor 2. A pulley 21, which is configured to rotate together with the output shaft, is connected to the output shaft of the motor 2. In the present embodiment, driving of the motor 2 is controlled by a controller 18 (see FIG. 1), which will be described in detail later.

Figure 3:
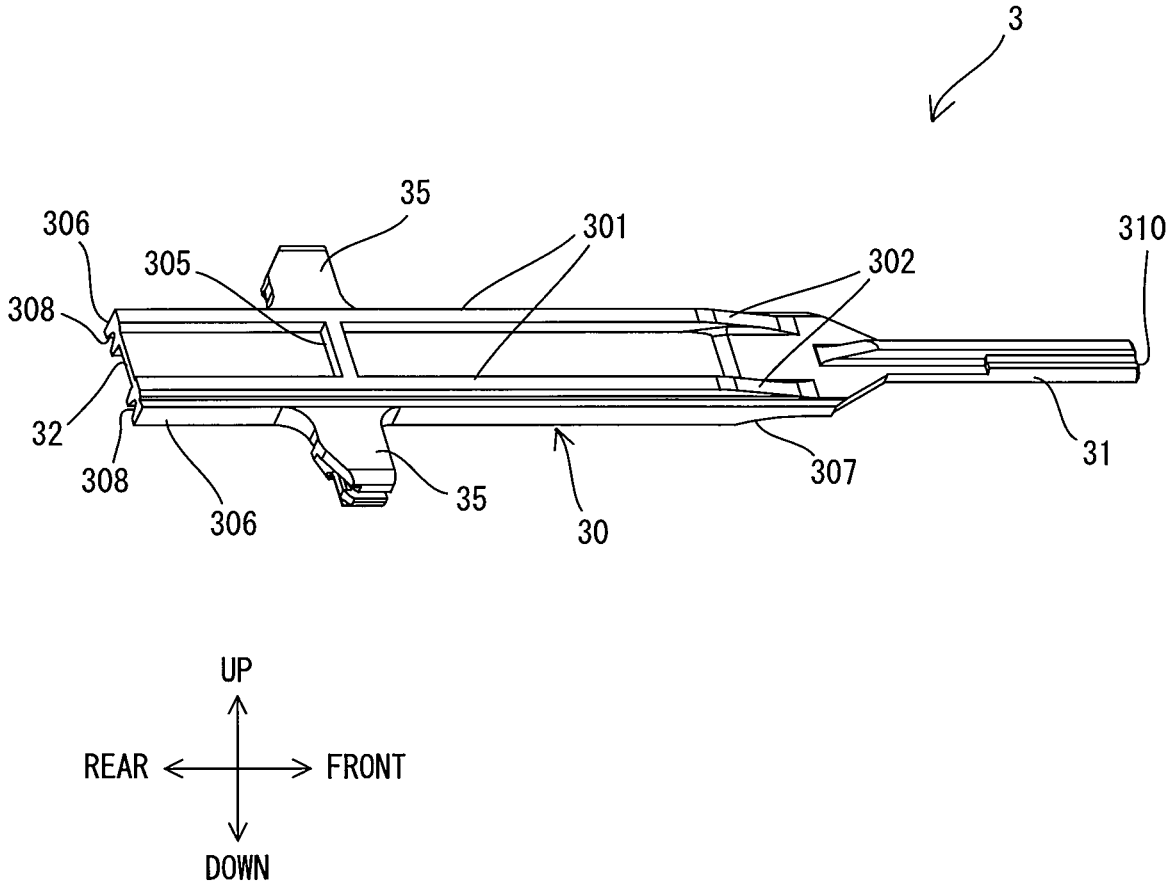
FIG. 3 is a perspective view of the driver when viewed from above.

As shown in FIG. 3, the driver 3 is an elongate member formed to be symmetrical in the right-left direction with respect to its longitudinal axis. The driver 3 includes a body 30, a striking part 31 and a pair of arm parts 35. The body 30 is a portion which has a generally rectangular plate-like shape as a whole. The striking part 31 is a portion which has a smaller width than the body 30 in the right-left direction and extends forward from a front end of the body 30. The arm parts 35 are portions which protrude to the right and left from a rear portion of the body 30.

The body 30 is a portion which is configured to be pressed by pressing rollers 83 (see FIG. 2), which will be described later, and to be frictionally engaged with ring members 5 (see FIG. 2). The body 30 includes a pair of roller-abutting parts 301, a lever-abutting part 305 and a pair of ring-engagement parts 306, which are described below in this order.

The roller-abutting parts 301 are integrally formed with the body 30, protruding upward from an upper surface of the body 30 and extending in the front-rear direction along right and left edges of the body 30. A surface formed on a protruding end (upper end) of each roller-abutting part 301 is formed as an abutting surface to abut on an outer peripheral surface of the pressing roller 83. A front end portion the roller-abutting part 301 is formed as an inclined part 302 which has a height (thickness in the up-down direction) gradually increasing toward the rear. On the other hand, a portion of the roller-abutting part 301 which extends rearward from the inclined part 302 has a constant height. The lever-abutting part 305 is formed to protrude upward from the upper surface of the body 30 and extends in the right-left direction so as to connect the right and left roller-abutting parts 301 in a rear portion of the body 30. The lever-abutting part 305 is a portion on which a push-out lever 711 to be described later may abut from the rear.

The ring-engagement parts 306 are integrally formed with the body 30, protruding downward from a lower surface of the body 30 and extending in the front-rear direction along the right and left edges of the body 30. A front end portion of each of the ring-engagement part 306 is formed as an inclined part 307 which has a height (thickness in the up-down direction) gradually increasing toward the rear. The ring-engagement parts 306 have respective engagement grooves 308 configured to engage with respective outer peripheral engagement parts 51 of two ring members 5, which will be described later. Each of the engagement grooves 308 is recessed upward from the protruding end of the ring-engagement part 306 and extends over the whole length of the ring-engagement part 306 in the front-rear direction. The engagement groove 308 is formed to have a width in the right-left direction decreasing toward the top (in other words, such that wall surfaces of the ring-engagement part 306 in the right-left direction which define the engagement groove 308 come closer to each other toward the top) (see FIG. 6). Engagement between the driver 3 and the ring member 5 will be described in detail later.

A rear end 32 of the body 30 defines a rear end of the driver 3. A front end 310 of the striking part 31 defines a front end of the driver 3. The front end 310 is a portion which is configured to strike a head of the nail 101 (see FIG. 1) to drive out the nail 101 forward into the workpiece 100.

The arm parts 35 protrude to the left and right from the body 30. Although not described in detail and shown, the arm parts 35 are each connected to a return mechanism disposed within the body housing 11, by a connecting member. The return mechanism is configured to return the driver 3 to an initial position after the nail 101 is driven out. In the nailing machine 1 of the present embodiment, any known structure may be adopted as the return mechanism. For example, the return mechanism may be configured to return the driver 3, which has been moved forward to a driving position, to the initial position along the operation line L by an elastic force of an elastic member (such as a compression coil spring or torsion coil spring) via the connecting member.

The driver 3 having the above-described structure is disposed such that its longitudinal axis extends in the front-rear direction of the nailing machine 1, along the operation line L. Further, the driver 3 is held to be movable along the operation line L (in other words, in the front-rear direction of the nailing machine 1 or in the longitudinal direction of the driver 3).

Figure 4:
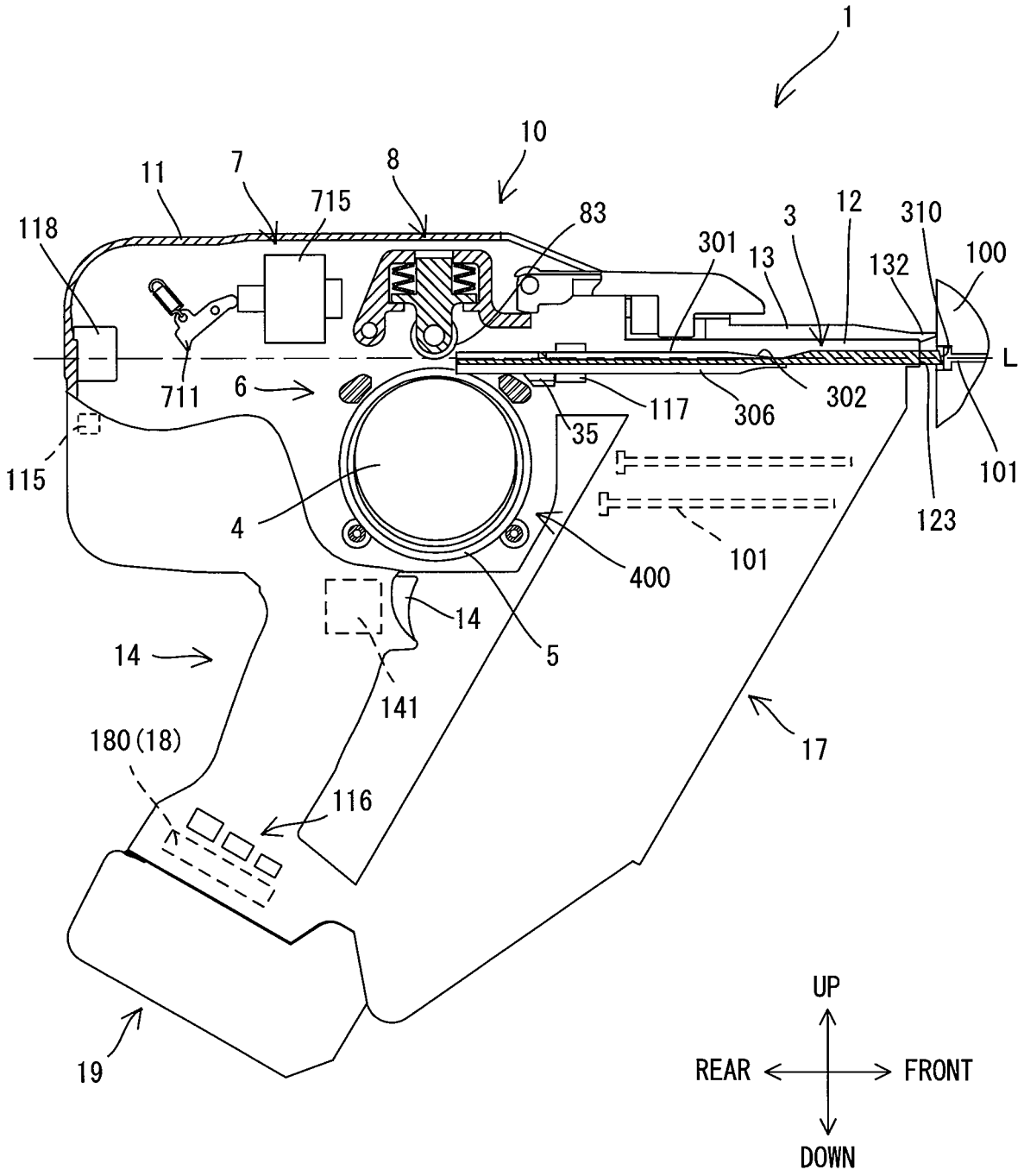
FIG. 4 is an explanatory drawing for schematically showing the driver placed in a driving position.

The initial position and the driving position of the driver 3 are now described with reference to FIGS. 1 and 4. The initial position is a position where the driver 3 is held in a state that the driver-driving mechanism 400 is not actuated (hereinafter referred to as initial state). In the present embodiment, as shown in FIG. 1, the initial position of the driver 3 is set to a position where the rear end 32 of the driver 3 abuts on a rear stopper part 118 fixed within a rear end portion of the body housing 11. The driving position is a position where the driver 3, which is moved forward by the driver-driving mechanism 400, drives the nail 101 into a workpiece. In the present embodiment, as shown in FIG. 4, the driving position of the driver 3 is set to a position where the front end 310 of the driver 3 slightly protrudes from the outlet 123. The driving position is also a position where front ends of the arm parts 35 respectively abut from the rear on a pair of front stopper parts 117 fixed within a front end portion of the body housing 11. With the above-described arrangement, in the present embodiment, the initial position and the driving position can also be respectively referred to as a rearmost position and a foremost position which define opposite ends of a movable range of the driver 3.

In the present embodiment, as shown in FIG. 2, the driver-driving mechanism 400 includes a flywheel 4, two ring members 5, a holding mechanism 6, an actuating mechanism 7 and a pressing mechanism 8. The structures of these components are now described in detail in this order. It is noted that, in FIGS. 1 and 2 to be referenced below, for convenience of explanation, the ring member 5 is shown partially cutaway.

Figure 5:
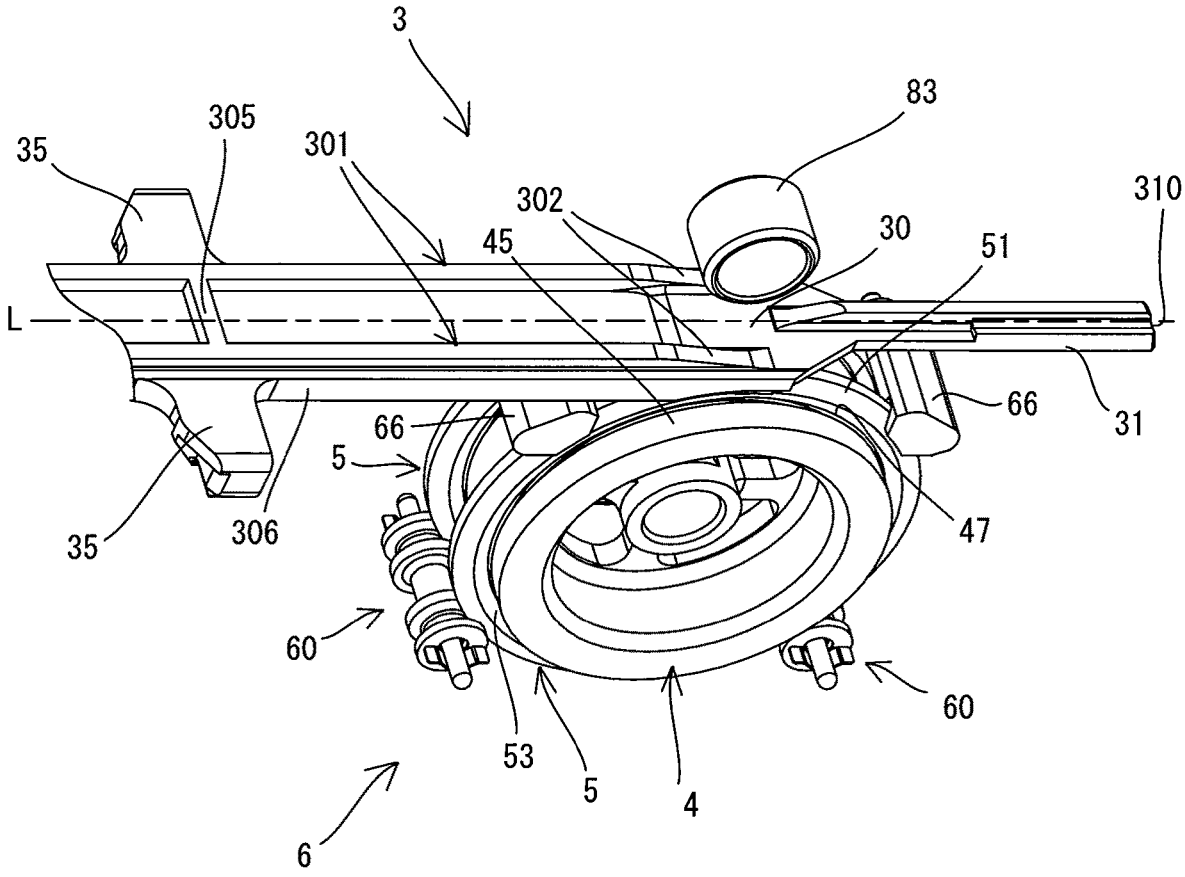
FIG. 5 is a perspective view of a flywheel, a ring member, a holding mechanism and a pressing roller when the driver is placed in the initial position.
Figure 6:
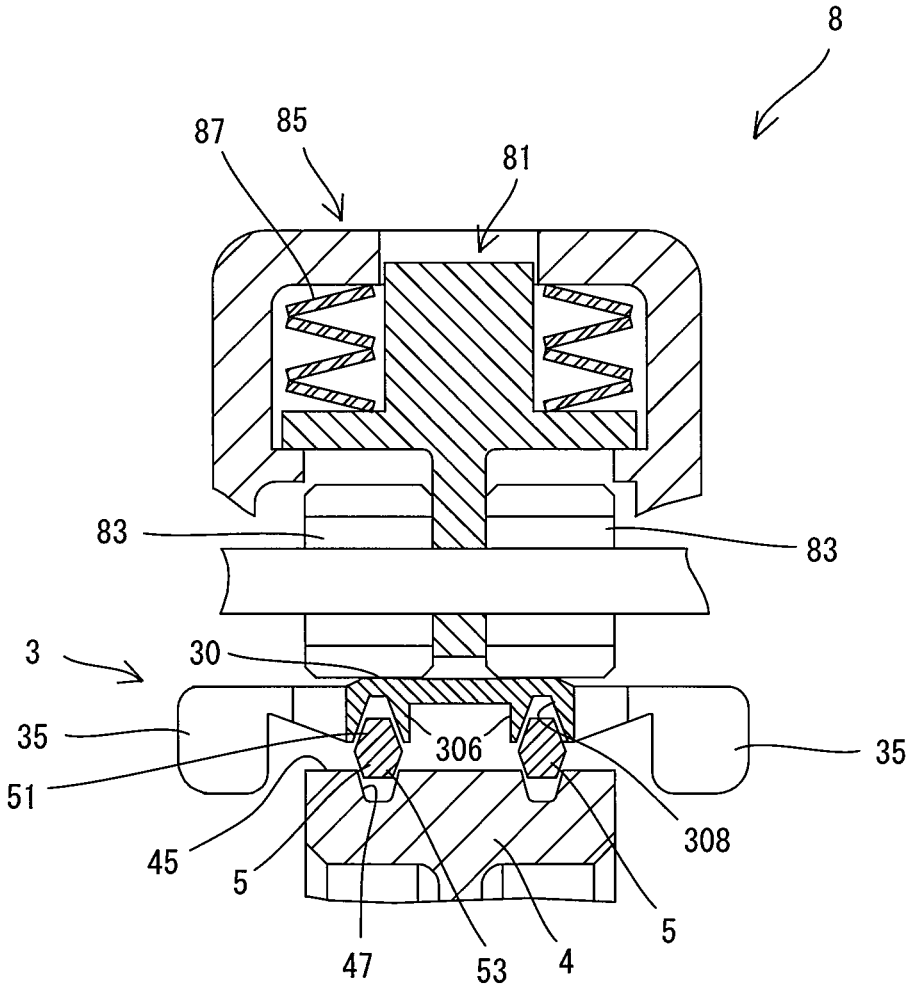
FIG. 6 is a sectional view taken along line VI-VI in FIG. 2.

The flywheel 4 has a circular cylindrical shape and is rotatably supported in front of the motor 2 within the body housing 11, as shown in FIG. 2. The flywheel 4 may be rotationally driven around a rotation axis A1 by the motor 2. The rotation axis A1 extends in parallel to a rotation axis of the motor 2 and in the right-left direction orthogonal to the operation line L of the driver 3. A pulley 41, which is configured to rotate together with the flywheel 4, is connected to a support shaft of the flywheel 4. A belt 25 is looped over the pulleys 21 and 41. Therefore, when the motor 2 is driven, rotation of the motor 2 is transmitted to the flywheel 4 via the belt 25, and the flywheel 4 rotates clockwise as viewed in FIG. 2. Further, as shown in FIGS. 5 and 6, a pair of engagement grooves 47 are formed to extend over the whole circumference of an outer periphery 45 of the flywheel 4. The engagement grooves 47 are configured to engage with the ring members 5. Each of the engagement grooves 47 is formed such that its width in the right-left direction decreases toward the inner side in the radial direction.

As shown in FIG. 2, each of the ring members 5 has a ring-like shape having a larger diameter than the flywheel 4. In the present embodiment, the inner radius of the ring member 5 is set to be larger than the radius of the flywheel 4 (strictly, the radius from the rotation axis A1 of the flywheel 4 to the bottom of the engagement groove 47). As shown in FIG. 5, the two ring members 5 are disposed radially outside of the engagement grooves 47 formed in the outer periphery 45 of the flywheel 4. In the present embodiment, the two ring members 5 are held by the holding mechanism 6, which will be described later, so as to be movable between a separate position where the ring member 43 is apart from the outer periphery 45 (more specifically, the engagement groove 47) of the flywheel 4 and a contact position where the ring member 43 is in partial contact with the outer periphery 45 (the engagement groove 47).

The ring member 5 is a transmitting member for transmitting the rotational energy of the flywheel 4 to the driver 3, and configured to be frictionally engaged with the driver 3 and the flywheel 4. As shown in FIG. 6, an outer peripheral engagement part 51 and an inner peripheral engagement part 53, which are respectively engageable with the engagement groove 308 of the driver 3 and the engagement groove 411 of the flywheel 41, are respectively formed in outer and inner peripheries of the ring member 5. The ring member 5 has a generally hexagonal cross-section in the radial direction. The outer peripheral engagement part 51 is formed such that its thickness in the axial direction of the ring member 5 decreases toward the outer side in the radial direction of the ring member 5, and the inner peripheral engagement part 53 is formed such that its thickness in the axial direction of the ring member 5 decreases toward the inner side in the radial direction of the ring member 5. In other words, both the outer peripheral engagement part 51 and the inner peripheral engagement part 53 are formed to have a cross-section tapered toward their respective tip ends in the radial direction. Engagement between the ring member 5 and the driver 3 and the flywheel 4 will be described in detail later.

The holding mechanism 6 is configured to hold the ring member 5 such that the ring member 5 is movable between the separate position, in which the ring member 43 is apart from the outer periphery 45 of the flywheel 4 (the engagement groove 47), and the contact position, in which the ring member 43 is in contact with the outer periphery 45 (the engagement groove 47). As shown in FIGS. 2 and 5, the holding mechanism 6 of the present embodiment includes a pair of ring-biasing parts 60 and a pair of stoppers 66. The ring-biasing parts 60 are respectively disposed diagonally forward and downward of the ring members 5 and diagonally rearward and downward of the ring members 5. The ring-biasing parts 60 rotatably support the ring members 5 while biasing the ring members 5 upward from below by leaf springs. The stoppers 66 are disposed below the driver 3 and respectively diagonally forward and upward of the ring members 5 and diagonally rearward and upward of the ring members 5. The stoppers 66 are configured to restrict upward movement of the ring members 5 while allowing rotation of the ring members 5.

The manner of holding the ring members 5 by the holding mechanism 6 is now described. As shown in FIG. 5, in the initial state, the ring-biasing parts 60 abut on the ring members 5 from below to bias the ring members 5 upward, while the stoppers 66 abut on the ring members 5 from above to prevent the ring members 5 from further moving upward. Thus, as shown in FIG. 6, the ring members 5 are each held in the separate position apart from the outer periphery 45 (the engagement groove 47) over the whole circumference of the flywheel 4, although only an upper end portion of the flywheel 4 is shown. On the other hand, as the driver 3 is moved forward by the actuating mechanism 7 and presses the ring members 5 downward, the ring members 5 are each moved downward against the biasing force of the ring-biasing parts 60 and held in the contact position in contact with the outer periphery 45 (the engagement groove 47) on an upper portion of the flywheel 4 (see FIG. 12), which will be described in further detail later.

As shown in FIG. 2, the actuating mechanism 7 is disposed above the driver 3 and rearward of the flywheel 4 within the body housing 11. The actuating mechanism 7 is configured to move the driver 3 from the initial position to a transmitting position to be described later. In the present embodiment, the actuating mechanism 7 mainly includes a solenoid 715 and the push-out lever 711 which may be turned by a rod of the solenoid 715. In the initial state, a leading end portion of the push-out lever 711 is held diagonally upward and rearward of the lever-abutting part 305 of the lever 3. When the solenoid 715 is actuated, the push-out lever 711 is turned downward and the leading end portion of the push-out lever 711 pushes the lever-abutting part 305 forward from the rear and thereby moves the driver 3 forward (see FIG. 11). It is noted that, in the present embodiment, the controller 18 (see FIG. 1) controls actuation of the solenoid 715, which will be described in detail later.

As shown in FIG. 2, the pressing mechanism 8 is disposed within the body housing 11 to face the driver 3 on the side opposite to the flywheel 4 in a direction in which the flywheel 4 and the driver 3 face with each other. The pressing mechanism 8 is configured to press the driver 3 toward the ring members 5 (that is, toward the flywheel 4) to thereby enable transmission of rotational energy from the flywheel 4 to the driver 3 via the ring members 5 in the process in which the driver 3 moves forward from the initial position.

As shown in FIGS. 2 and 6, in the present embodiment, the pressing mechanism 8 includes a roller support member 81, the pressing rollers 83, a holder 85 and an elastic member 87. The pressing rollers 83 are rotatably supported by the roller support member 81. The holder 85 is supported by the body housing 11 and holds the roller support member 81 so as to be movable in the up-down direction. The elastic member 87 is disposed between the roller support member 81 and the holder 85 while being slightly compressed. With such a structure, in the initial state, the roller support member 81 and the pressing rollers 83 are biased downward by elastic force of the elastic member 87 and held in a lowermost position.

As shown in FIG. 2, the acceleration sensor 115 is disposed within the rear end portion of the body housing 11. The acceleration sensor 115 is a well-known sensor which is capable of detecting acceleration, and configured to output a detection result to the controller 18 (see FIG. 1) via wiring (not shown). In the present embodiment, acceleration is used as information corresponding to movement of the tool body 10 which is caused by the driving operation. The motor 2 is controlled based on acceleration detected by the acceleration sensor 115, which will be described in detail later.

The internal configuration of the handle 14 is now described.

As shown in FIG. 2, the trigger switch 141 is disposed inside an upper end portion of the handle 14, as described above. The controller 18 is housed inside a lower end portion of the handle 14 (above the battery mounting part 15). The controller 18 is configured to control operations of the driver-driving mechanism 400 by controlling the motor 2 and the solenoid 715. Further, a speed display part 116 is provided on the lower end portion of the handle 14 (above the controller 18). In the present embodiment, the speed display part 116 includes three LED lights having different sizes. The controller 18 (see FIG. 1) controls drive of the LEDs according to the set rotation speed of the motor 2. Specifically, the number, color and driving mode (lighting or blinking) of the LEDs to be driven may be changed according to the rotation speed of the motor 2.

Figure 7:
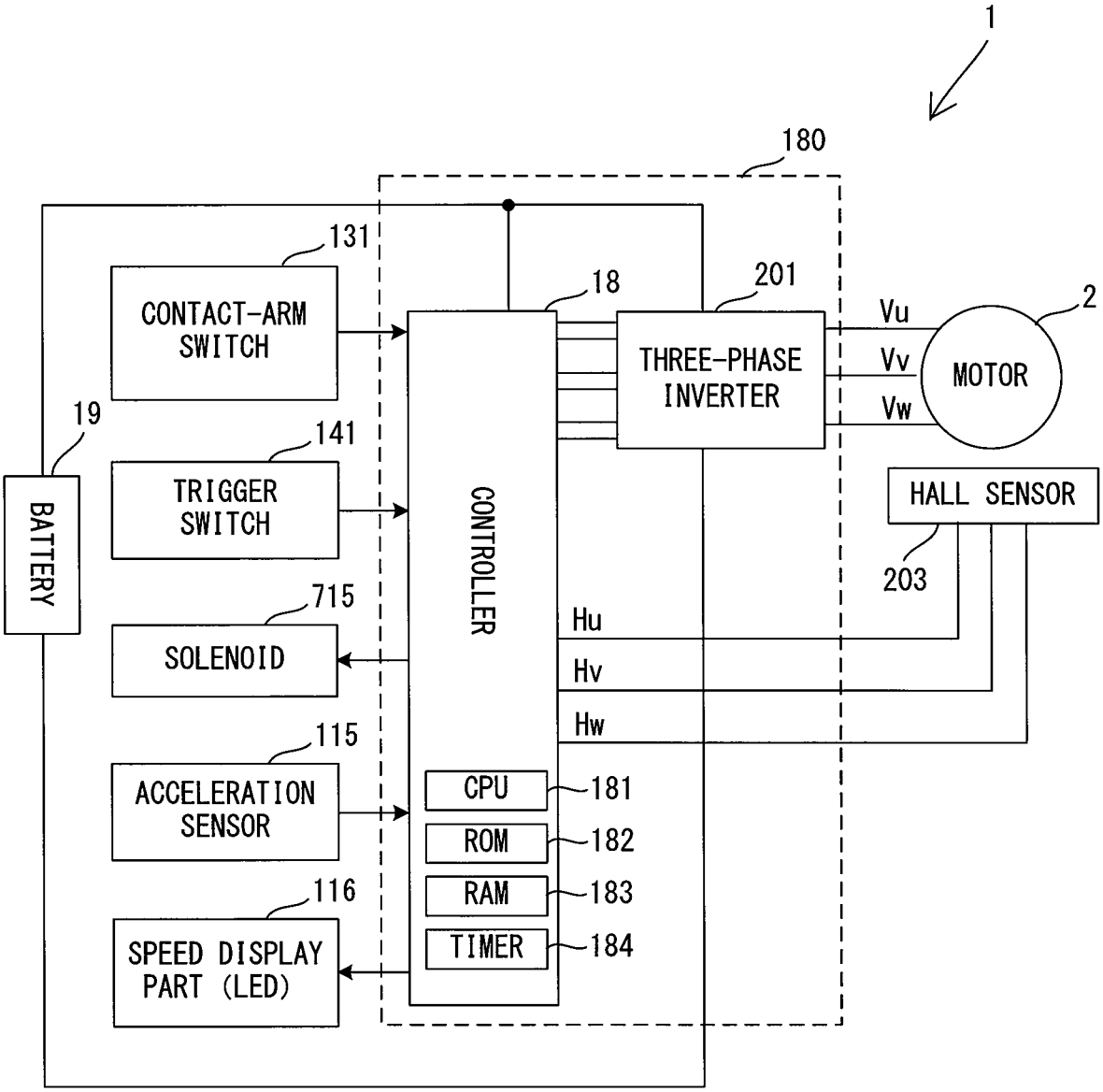
FIG. 7 is a block diagram showing an electrical configuration of the nailing machine.

The electrical configuration of the nailing machine 1 is now described. As shown in FIG. 7, the nailing machine 1 includes the controller 18 for controlling operations of the nailing machine 1. In the present embodiment, the controller 18 is configured as a microcomputer including a CPU 181, a ROM 182, a RAM 183 and a timer 184.

A three-phase inverter 201 and a Hall sensor 203 are electrically connected to the controller 18. In the present embodiment, the three-phase inverter 201 has a three-phase bridge circuit using six semiconductor switching elements. The three-phase inverter 201 is configured to drive the motor 2 by switching each of the switching elements of the three-phase bridge circuit according to the duty ratio indicated by a control signal from the controller 18. The Hall sensor 203 includes three Hall elements which are each disposed to correspond to each phase of the motor 2. The Hall sensor 203 is configured to output a signal which indicates the rotation position of a rotor of the motor 2. Actual rotation speed of the motor 2 may be obtained from the rotation position detected by the Hall sensor 203, so that it can also be said that the Hall sensor 203 is configured to detect the rotation speed of the motor 2. Although described in detail later, in the present embodiment, the controller 18 (the CPU 181) controls the rotation speed of the motor 2 by changing the duty ratio based on the rotation speed of the motor 2 which is detected before and after a driving operation. The controller 18 and the three-phase inverter 201 are mounted on a board 180 and housed in the lower end portion of the handle 14 (see FIG. 1).

Further, the contact arm switch 131, the trigger switch 141, the solenoid 715, the acceleration sensor 115 and the speed display part (LEDs) 116 are electrically connected to the controller 18. In the present embodiment, the CPU 181 controls driving of the motor 2 and the solenoid 715 by appropriately outputting control signals to the three-phase inverter 201 and the solenoid 715 based on signals outputted from the contact arm switch 131, the trigger switch 141 and the acceleration sensor 115. Further, the CPU 181 controls lighting of the speed display part (LEDs) 116 according to the rotation speed of the motor 2.

Control of the nailing machine 1 in the present embodiment is now briefly described.

First, as described above, performing both operations of pressing the contact arm 13 and depressing the trigger 140 (regardless of the order) is defined as conditions for starting a driving operation. It is noted here that a certain amount of time is required after driving of the motor 2 is started, in order to store in the flywheel 4 the rotational energy which is sufficient to drive the nail 101 with the driver 3. Therefore, in the present embodiment, in order to establish a state in which sufficient rotational energy is already stored in the flywheel 4 at the time when the two operations are performed, the two operations are treated as follows. One of the two operations which is performed first is regarded as an input operation for inputting an instruction of driving the motor 2 in advance to enter a standby state (hereinafter referred to as a standby instruction). The other operation which is performed later is regarded as an input operation for inputting an instruction of actuating the solenoid 715 (hereinafter referred to as an actuation instruction).

Further, release of the depressing operation of the trigger 140 after the two operations are performed (in other words, after a driving operation is performed once) is regarded as an input operation for inputting an instruction of cancelling the standby state (hereinafter referred to as a standby-cancel instruction). On the other hand, the operation of pressing the contact arm 13 which is performed without cancelling the standby state (that is, while the depressing operation of the trigger 140 is continued) is regarded as an input operation for inputting a new actuation instruction. In other words, in a case where the depressing operation of the trigger 140 is continued and the standby state is maintained, a next driving operation can be performed in response to the operation of pressing the contact arm 13. As a result, rotational energy can be efficiently stored and operability in continuously driving the nails 101 can be improved.

As described above, in the present embodiment, driving of the motor 2 is started and stopped in response to the above-described input operations for inputting various instructions. Specifically, the CPU 181 recognizes various instructions based on the on/off states of the contact arm switch 131 and the trigger switch 141 and starts or stops driving of the motor 2 according to the instructions.

Further, the inventor of the present application has focused on the fact that certain correspondences exist between the rotational energy of the flywheel 4 before a driving operation and the rotational energy of the flywheel 4 consumed in the driving operation by the driver 3 (hereinafter referred to as energy consumption), and the state of the nail 101 driven into the workpiece 100. Here, the energy consumption is a difference between rotational energy of the flywheel 4 before a driving operation (hereinafter referred to as pre-driving energy) and rotational energy of the flywheel 4 after the driving operation (hereinafter referred to as post-driving energy). In the present embodiment, the rotation speed of the motor 2 is set based on the correspondences every time a driving operation is actually performed, so that the rotational energy for a next driving operation is controlled to be within a range in which the nail 101 can be properly driven into the workpiece 100.

Specifically, the CPU 181 sets rotation speed N of the motor 2 with reference to a table 187 illustrated in FIG. 8 every time a driving operation is performed, and drives the motor 2 at the set rotation speed N. It is noted that the table 187 is stored in advance in the ROM 182 (see FIG. 7) of the controller 18.

The table 187 is now described. As shown in FIG. 8, rotation speed N1 (rpm: revolutions per minute) of the motor 2 before a driving operation, a range of rotation speed N2 (rpm) of the motor 2 after the driving operation, and rotation speed N (rpm) of the motor 2 for a next driving operation are associated with each other and stored in the table 187.

The table 187 is prepared based on a driven state of the nail 101 which is specified for each of several different rotation speeds at which the flywheel 4 is actually rotated. The driven state of the nail 101 includes, for example, a proper state, an insufficient state and an excessive state. The proper state refers to a state in which a head of the driven nail 101 is substantially flush with a surface of the workpiece 100 and corresponds to a case in which energy consumption is proper. The insufficient state refers to a state in which the head of the nail 101 protrudes from the surface of the workpiece 100 and corresponds to a case in which energy consumption is insufficient. The excessive state refers to a state in which the head of the nail 101 is buried in the workpiece 100 and corresponds to a case in which energy consumption is excessive. In a case where the driven state of the nail 101 is proper, the rotational energy to be supplied to the driver 3 for the next driving operation need not be changed. In a case where the driven state of the nail 101 is insufficient, it is preferred to increase the rotational energy to be supplied to the driver 3 according to the degree of insufficiency. In a case where the driven state of the nail 101 is excessive, it is preferred to reduce the rotational energy to be supplied to the driver 3 according to the degree of excessiveness.

Considering the above, the pre-driving energy can be associated with a range of the post-driving energy which corresponds to the proper state, a range of the post-driving energy which corresponds to the insufficient state, and a range of the post-driving energy which corresponds to the excessive state. Further, each of the ranges of the post-driving energy can be associated with the necessity for increase or decrease of the rotational energy to be supplied to the driver 3 in the next driving operation. It is noted that the ranges of the post-driving energies which respectively correspond to the insufficient state and the excessive state can be further subdivided into a plurality of ranges according to the degree of insufficiency and the degree of excessiveness, respectively.

When the rotational energy of the flywheel 4 is defined as E (J: joule), the moment of inertia of the flywheel 4 is defined as I ($kg \cdot m^2$: kilogram square meter) and the angular velocity of the flywheel 4 is defined as ω (rad/s: radians per second), the rotational energy E can be expressed by the following equation:

$$E=I\omega^2/2$$

The moment of inertia I of the flywheel 4 is constant, and the angular velocity ω (rad/s) of the flywheel 4 can be converted into the rotation speed (rpm). Further, the rotation speed of the flywheel 4 has a proportional relation to the rotation speed of the motor 2 according to the rotation ratio between the pulleys 21 and 41. Therefore, the rotational energy of the flywheel 4 can be expressed as a function of the rotation speed of the motor 2. In the present embodiment, in order to facilitate the processing, the rotation speed N1 of the motor 2 before a driving operation is employed as information corresponding to the pre-driving energy, and the rotation speed N2 of the motor 2 after the driving operation is employed as information corresponding to the post-driving energy. In the present embodiment, in particular, since a brushless motor is employed as the motor 2, the Hall sensor 203 for detecting the rotation position of the rotor is required, in the first place. Therefore, appropriate information can be easily obtained as the information corresponding to the pre-driving energy and the post-driving energy, by utilizing the rotation speeds N1 and N2 of the motor 2, without the need for providing an additional detecting mechanism.

Increase or reduction of the rotational energy to be supplied to the driver 3 can be realized by increase or reduction of the rotational energy of the flywheel 4, and thus increase or reduction of the rotation speed of the motor 2, before the next driving operation. Therefore, the range in which the rotational energy to be supplied to the driver 3 need not be changed is associated with rotation speed N of the motor 2 for the next driving operation which is the same as the rotation speed N1. The range in which the rotational energy to be supplied to the driver 3 needs to be increased is associated with rotation speed N which is higher than the rotation speed N1. Further, the range in which the rotational energy to be supplied to the driver 3 needs to be reduced is associated with rotation speed N which is lower than the rotation speed N1.

More specifically, for example, in a case where the rotation speed N1 of the motor 2 before a driving operation is 12,000 rpm, the rotation speed N2 of the motor 2 after the driving operation in the range of less than 7,000 rpm is associated with rotation speed N of 12,000 rpm, which is the same as the rotation speed N1. In other words, in a case where the rotation speed N1 is 12,000 rpm and the rotation speed N2 is less than 7,000 rpm, the energy consumption is within a proper range, so that the rotation speed N is not changed from that in the previous driving operation. In the present embodiment, a maximum speed within a settable range is 12,000 rpm.

Further, the rotation speed N2 in the range of 7,000 to 8,000 rpm is associated with the rotation speed N of 11,000 rpm, which is lower than the rotation speed N1. Specifically, in a case where the rotation speed N1 is 12,000 rpm and the rotation speed N2 is in the range of 7,000 to 8,000 rpm, energy consumption is within a range of the excessive state, so that the rotation speed N is set lower than that in the previous driving operation, in order to reduce the rotational energy to be supplied to the driver 3. In a case where the rotation speed N2 is in the range of 8,000 to 9,000 rpm, the energy consumption is within a range of a further excessive state, so that the rotation speed N2 in this range is associated with further lower rotation speed N of 10,000 rpm. The rotation speed N2 in the range of 9,000 rpm or more is similarly associated with the rotation speed N, although not described in detail here. In the present embodiment, a minimum speed within the settable range is 8,000 rpm.

Further, for example, in a case where the rotation speed N1 of the motor 2 before a driving operation is 11,000 rpm, the rotation speed N2 of the motor 2 after the driving operation in the range of less than 5,000 rpm is associated with the maximum speed of 12,000 rpm, as the rotation speed N of the motor 2 for the next driving operation. It is noted that 5,000 rpm is a threshold of the rotation speed N2 when the rotation speed N1 is 11,000 rpm. It is known that the rotation speed of the motor 2 significantly decreases when the driven state of the nail 101 is significantly insufficient. Therefore, when the rotation speed N2 is lower than the threshold, the maximum speed is set as the rotation speed N, in order to effectively increase the rotational energy to be supplied to the driver 3. Although not described in detail, in the rest of the table 187, the rotation speed N1, the rotation speed N2 and the rotation speed N are also associated with each other based on similar criteria.

Details of driving control processing to be executed by the CPU 181 of the controller 18 and specific operations of the nailing machine 1 during this processing are now described with reference to FIGS. 9 and 10. The driving control processing is started when the battery 19 is mounted to the battery mounting part 15 and power supply to the nailing machine 1 is started. The driving control processing is terminated when the power supply is stopped. In the following description and drawings, each "step" in the processing is simply expressed as "S". Further, in the drawings, the "switch" is also simply expressed as "SW".

At the start of the driving control processing, the contact arm 13 and the trigger 140 are both in their initial positions, and the contact arm switch 131 and the trigger switch 141 are both in the off-state. The motor 2 is in a non-driven state, in which the motor 2 is not yet driven. As shown in FIG. 1, the driver 3 has been returned to the initial position by the return mechanism and is held in the initial position. As shown in FIG. 6, each of the ring members 5 is held by the holding mechanism 6 in the separate position slightly apart radially outward from the outer periphery 45 (more specifically, from the engagement groove 47) of the flywheel 4. At this time, each of the pressing rollers 83 is held in the lowermost position and in sliding contact with the front end portion of the body 30 of the driver 3 from above, but not yet pressing the driver 3 downward. In this state, each of the ring members 5 is also held in a position apart from the driver 3. More specifically, each of the ring members 5 is held in a position in which the outer peripheral engagement part 51 is slightly apart downward from the corresponding engagement groove 308 of the driver 3.

Figure 9:
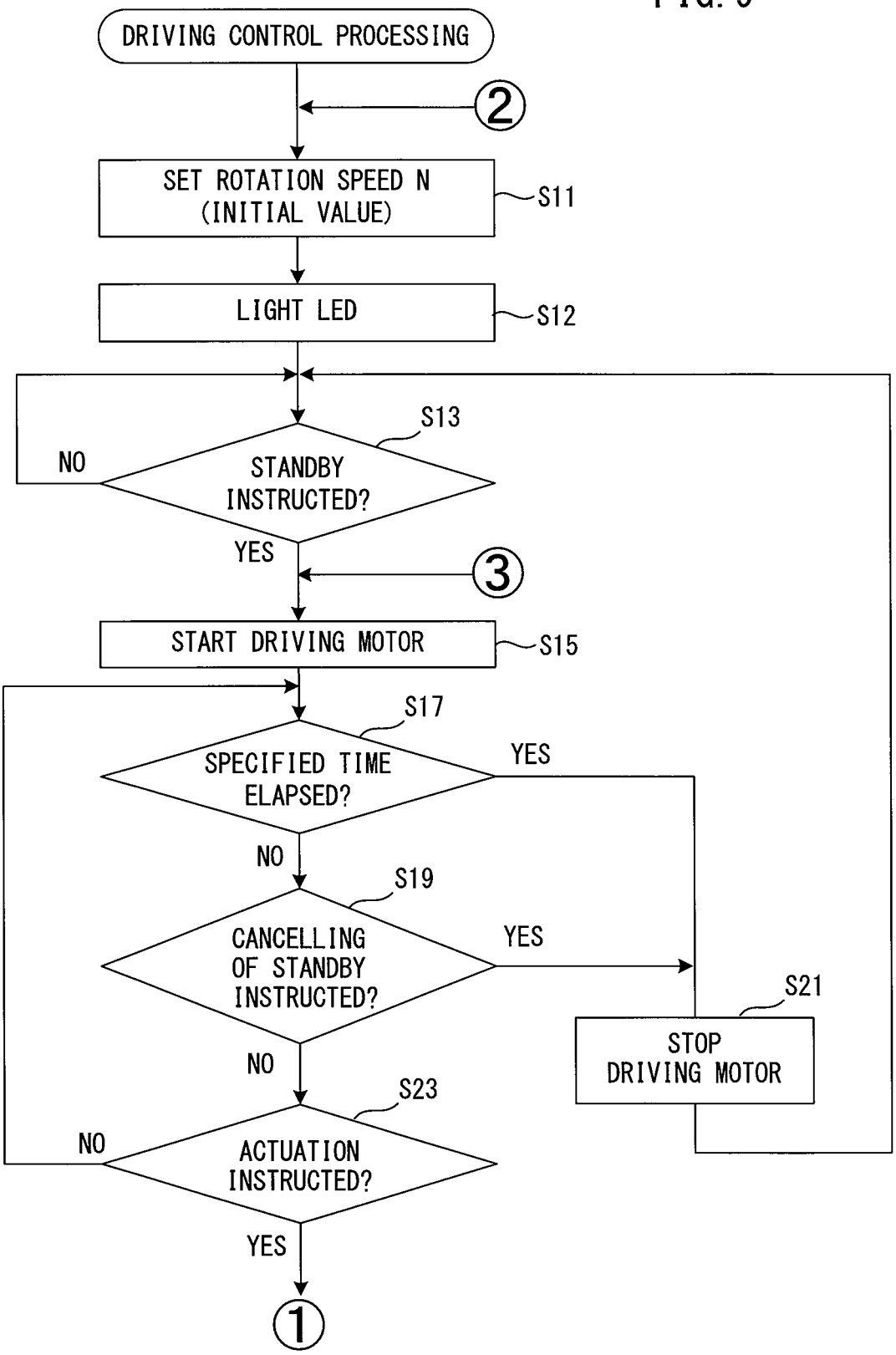
FIG. 9 is a flowchart of driving control processing which is executed by a CPU.

As shown in FIG. 9, the CPU 181 first sets an initial value as the rotation speed N of the motor 2 (S11). In the present embodiment, the initial value is a maximum value (maximum speed of 12,000 rpm) within the settable range of the rotation speed N. The initial value is stored in advance in the ROM 182, and in S11, the CPU 181 reads out the initial value from the ROM 182 and stores the initial value in the RAM 183, as the rotation speed N of the motor 2 for the next driving operation.

The CPU 181 lights the LEDs of the speed display part 116 according to the rotation speed N of the motor 2 (S12). At this time, all of the three LEDs are lighted to indicate that the rotation speed N is set to the maximum value. Thus, a user can readily recognize the automatically set rotation speed N.

The CPU 181 waits until a standby instruction is inputted (S13: NO, S13). When either the contact arm switch 131 or the trigger switch 141 is turned on, the CPU 181 recognizes this as an input of the standby instruction (S13: YES), and starts driving of the motor 2 (S15). Specifically, the CPU 181 starts energization to the motor 2 via the three-phase inverter 201. At this time, the CPU 181 controls the duty ratio such that the rotation speed of the rotor of the motor 2 becomes the rotation speed N stored in the RAM 183. Further, the on/off states of the trigger switch 141 and the contact arm switch 131 which are recognized by the controller 18 are stored, for example, when their respective corresponding flags are set or cleared in the RAM 183.

When the flywheel 4 is rotationally driven along with driving of the motor 2, storage of the rotational energy is started. At this stage, the ring members 5 are each held in the separate position and are thus incapable of transmitting the rotational energy of the flywheel 4 to the driver 3. Therefore, even if the flywheel 4 rotates, the ring members 5 and the driver 3 do not operate.

The CPU 181 continues to monitor until a standby-cancel instruction or an actuation instruction is inputted before a specified time elapses after the standby instruction is inputted (S17: NO, S19: NO, S23: NO, S17). The standby-cancel instruction as used herein corresponds to turning off of the contact arm switch 131 or the trigger switch 141, which has been used to input the standby instruction.

In a case where the specified time elapses without an input of the standby-cancel instruction or the actuation instruction (S17: YES) or in a case where the standby-cancel instruction is inputted within the specified time (S17: NO, S19: YES), the CPU 181 stops driving of the motor 2 (S21), and returns to monitoring of input of the standby instruction (S13). It is noted that whether the specified time has elapsed or not is determined, for example, by counting the elapsed time after input of the standby instruction with the timer 184, and comparing the elapsed time with the specified time stored in advance in the ROM 182. The specified time is not particularly limited, but, for example, in the present embodiment, it is set to 5 seconds.

In a case where the actuation instruction is inputted before the specified time elapses, that is, in a case where the contact arm switch 131 or the trigger switch 141 which has not been used to input to the standby instruction is also turned on (S17: NO, S19: NO, S23: YES), the CPU 181 specifies the rotation speed N1 of the motor 2 before the driving operation, which is detected by the Hall sensor 203 (see FIG. 7), and stores it in the RAM 183 (S25 in FIG. 10). The CPU 181 stops driving of the motor 2 (S27) by once stopping energization to the motor 2. Although driving of the motor 2 is stopped, the flywheel 4 and the rotor of the motor 2 continue to rotate by inertia. Substantially at the same time when driving of the motor 2 is stopped, the CPU 181 actuates the solenoid 715 in response to the actuation instruction, thereby causes the driver 3 to perform a driving operation (S29).

Specifically, the driving operation is performed as follows. First, when the solenoid 715 is actuated, the push-out lever 711 turns and the leading end portion of the push-out lever 711 pushes the lever-abutting part 305 of the driver 3 forward from the rear. Thus, the driver 3 starts moving forward from the initial position toward the driving position along the operation line L. The driver 3 also moves relative to the ring members 5 each held in the separate position.

The pressing rollers 83 abut on the respective abutment surfaces of the inclined parts 302 from the front. As the inclined parts 302 move forward while being pressed by the pressing rollers 83, a portion of the outer peripheral engagement part 51 of each of the ring members 5 enters the corresponding engagement groove 308 (see FIG. 6) of the driver 3 and abuts on an open end of the engagement groove 308. Further, with the structure in which the inclined part 307 is formed in the front end portion of the ring-engagement part 306 and the width of the engagement groove 308 in the right-left direction increases toward the open end, the outer peripheral engagement part 51 can smoothly enter the engagement groove 308. When the driver 3 further moves forward, while the pressing rollers 83 abut on the respective abutment surfaces of the inclined parts 302 and a portion of the outer peripheral engagement part 5 abuts on the open end of the corresponding engagement groove 308, each of the inclined parts 302 functions as a cam and exhibits a wedge effect. Therefore, the ring members 5 are each pushed downward from the separate position against the biasing force of the ring-biasing parts 60. At the same time, the pressing rollers 83 are each pushed upward from the lowermost position against the biasing force of the elastic member 87.

Figure 11:
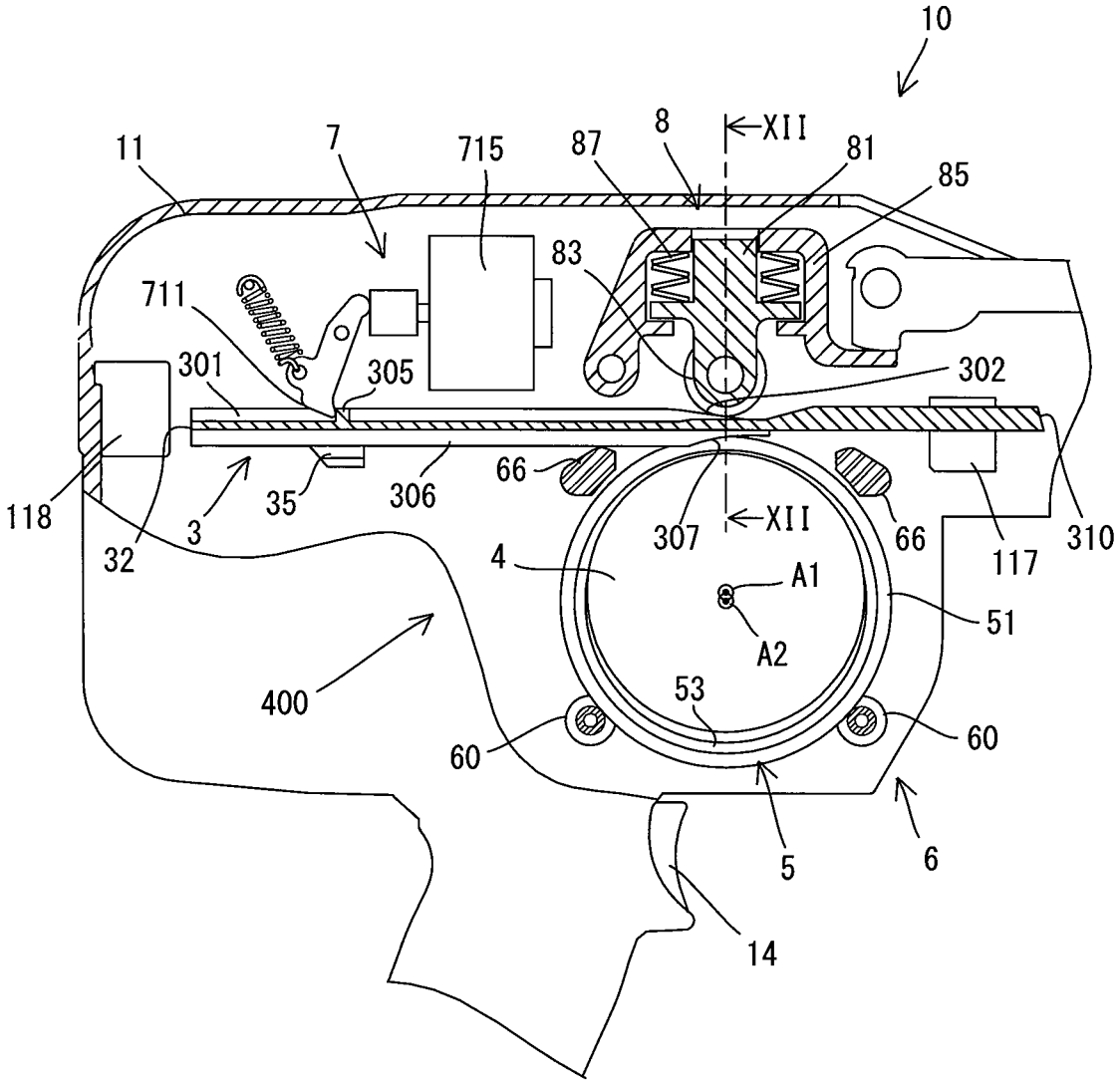
FIG. 11 is an explanatory drawing for illustrating the driver placed in a transmitting position and a driver-driving mechanism.
Figure 12:
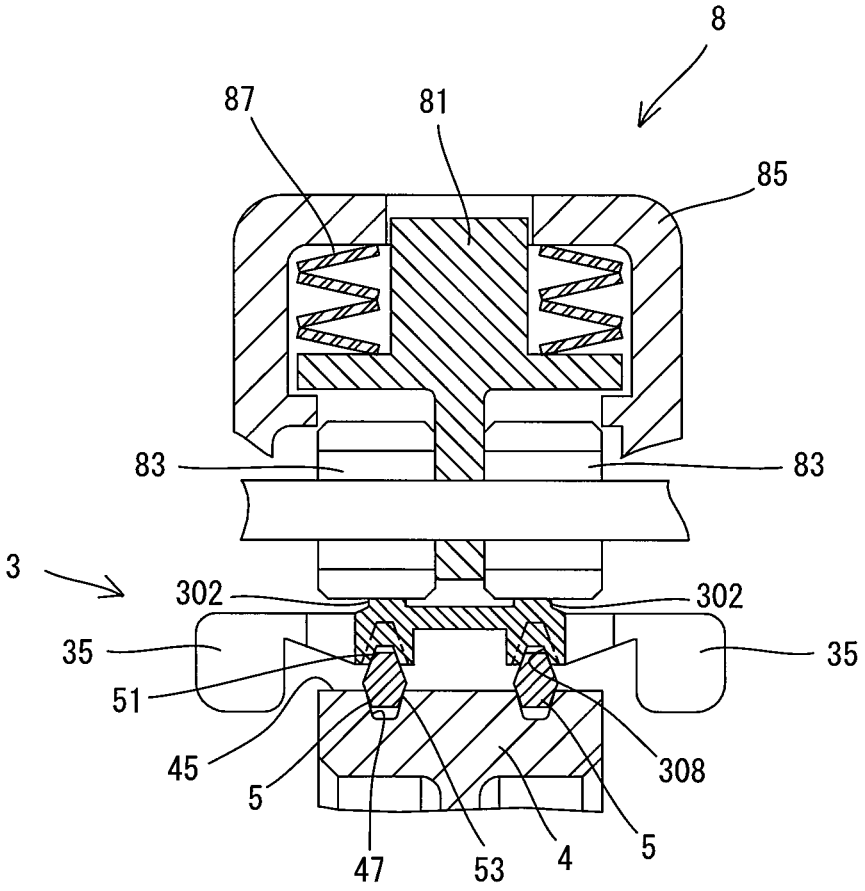
FIG. 12 is a sectional view taken along line XII-XII in FIG. 11.

When the driver 3 further moves forward and reaches the transmitting position shown in FIG. 11, as shown in FIG. 12, a portion of the inner peripheral engagement part 53 of each of the ring members 5 moved downward enters the corresponding engagement groove 47 of the flywheel 4 and abuts on an open end of the engagement groove 47, so that the ring members 5 are prevented from further moving downward. At this time, each of the ring members 5 is rotatably supported in the lowermost position by the ring-biasing parts 60 while being separated from the stoppers 66, and only a portion of the inner peripheral engagement part 53 abuts on an upper portion of the flywheel 4. Thus, the ring members 5 are each held in the contact position by the holding mechanism 6. Further, the ring members 5 are pressed against the flywheel 4 via the driver 3 by the elastic force of the elastic member 87 which is compressed when the pressing rollers 83 are pushed up by the inclined parts 302.

Therefore, a portion of the outer peripheral engagement part 51 of each of the ring members 5 is frictionally engaged with the driver 3 at the open end of the engagement groove 308 of the driver 3, and a portion of the inner peripheral engagement part 53 of each of the ring members 5 is frictionally engaged with the flywheel 4 at the open end of the engagement groove 47 of the flywheel 4.

Thus, when the ring members 5 are frictionally engaged with the driver 3 and the flywheel 4, the driver 3 becomes capable of receiving the rotational energy of the flywheel 4 via the ring member 5. Here, a "frictionally engaged state" refers to a state (including a sliding state) that two members are engaged with each other by friction. Each of the ring members 5 is rotated around the rotation axis A2 by the flywheel 4 in a state in which only a portion of the inner peripheral engagement part 53 of the ring member 5 which is pressed against the flywheel 4 by the driver 3 is frictionally engaged with the flywheel 4. Further, in the present embodiment, as shown in FIG. 11, the ring member 5 is formed to have a larger diameter than the flywheel 4, and the inner radius of the ring member 5 is set to be larger than the outer radius of the flywheel 4 (strictly, the radius from the rotation axis A1 of the flywheel 4 to the bottom of the engagement groove 47). Therefore, the rotation axis A2 of the ring member 5 is different from the rotation axis A1 of the flywheel 4 and extends below the rotation axis A1 (in a position further apart from the driver 3). Further, the rotation axis A2 extends in parallel to the rotation axis A1. The ring members 5 push out the driver 3 forward from the transmitting position shown in FIG. 11 while being frictionally engaged with the driver 3.

Figure 13:
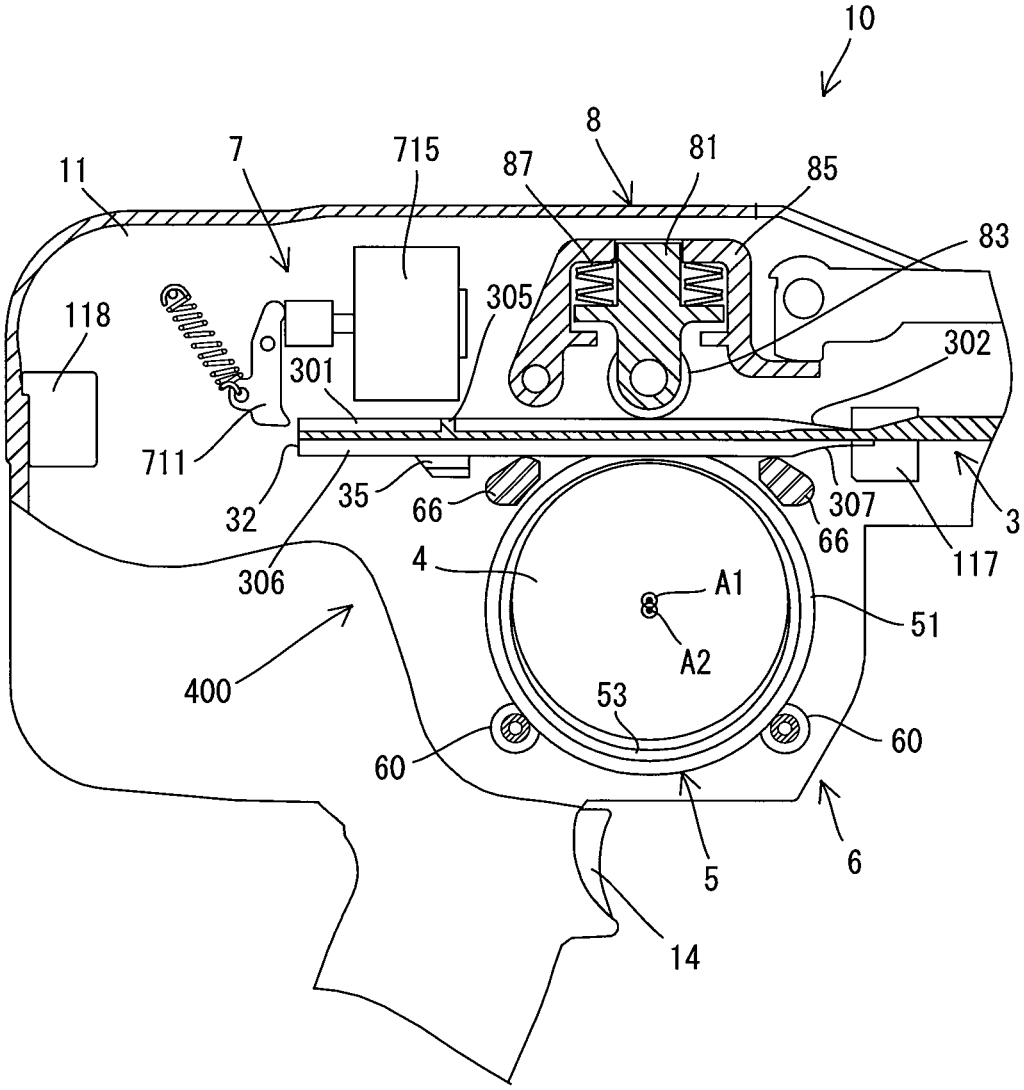
FIG. 13 is an explanatory drawing for illustrating the driver placed in a striking position and the driver-driving mechanism.

When the driver 3 is pushed out forward from the transmitting position, as shown in FIG. 13, each of the pressing rollers 83 abuts on the abutment surface of a portion of the roller-abutting part 301 which extends rearward from the inclined part 302, and is pushed up to an uppermost position. The ring members 5 are further pressed against the flywheel 4 via the driver 3 by the elastic force of the elastic member 87. Therefore, frictional engagements between the driver 3 and a portion of the outer peripheral engagement part 51 and between the flywheel 4 and a portion of the inner peripheral engagement part 53 get firmer. Thus, the ring members 5 can more efficiently transmit the rotational energy of the flywheel 4 to the driver 3. FIG. 13 shows the state in which the driver 3 is placed in a striking position where the driver 3 strikes the nail 101 (see FIG. 1). Further, when a specified time required for the driver 3 to reach the striking position elapses after actuation of the solenoid 715 in S29 of the driving control processing (see FIG. 10), the CPU 181 stops supply of current to the solenoid 715 to thereby return the push-out lever 711 to the initial position.

The driver 3 reaches the striking position and strikes the nail 101, and further moves to the driving position shown in FIG. 4 and drives the nail 101 into the workpiece 100. When front ends of the arm parts 35 of the driver 3 abut on the front stopper parts 117 from the rear, movement of the driver 3 is stopped and the driving operation is finished. Accordingly, the return mechanism (not shown) is actuated to return the driver 3 to the initial position.

Figure 10:
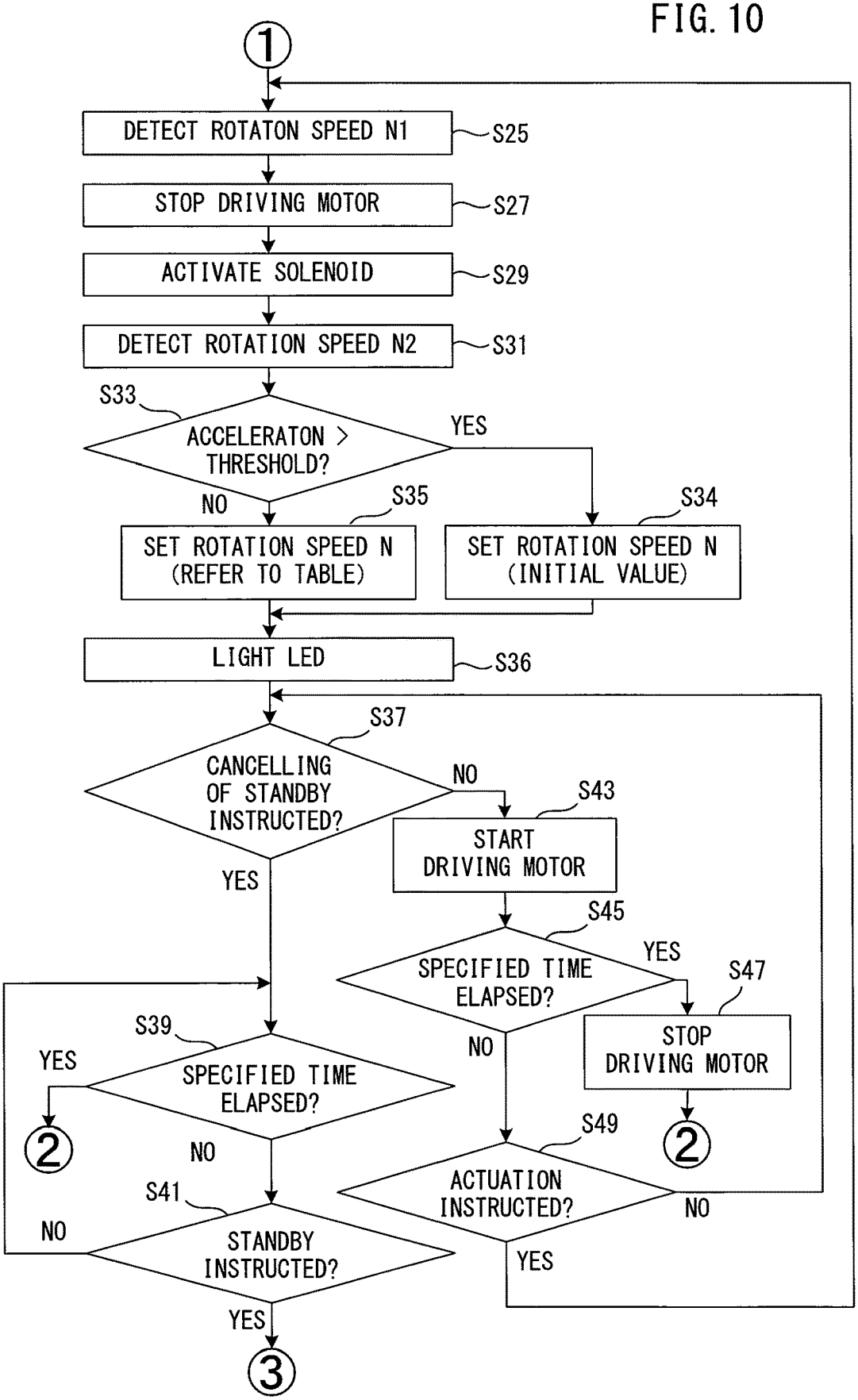
FIG. 10 is a sequel to FIG. 9, showing the flowchart of the driving control processing.

As shown in FIG. 10, the CPU 181 actuates the solenoid 715 in S29, and then when the driving operation of the driver 3 is finished, the CPU 181 specifies the rotation speed N2 of the motor 2 after the driving operation, which is detected by the Hall sensor 203, and stores the rotation speed N2 in the RAM 183 (S31). The timing of specifying the rotation speed N2 may be set, for example, according to the time required for the driver 3 to move to the driving position and complete the operation of driving the nail 101 after the solenoid 715 is actuated. It is noted that the time required for the driver 3 to move to the driving position and complete the operation of driving the nail 101 is quite short (about 30 milliseconds).

Further, the CPU 181 determines whether or not the acceleration detected by the acceleration sensor 115 exceeds a specified threshold (S33). The threshold of the acceleration is set and stored in advance, for example, in the ROM 182. As describe above, the acceleration is employed as the information corresponding to the movement of the tool body 10 which is caused by the driving operation. In such a case in which the nail 101 is hardly driven into the workpiece 100 and the tool body 10 is rebounded by reaction (typically, moves in a direction away from the workpiece substantially in parallel to the operation line L) (specifically, in a case where energy consumption is significantly insufficient), the acceleration increases. Therefore, in a case where the acceleration exceeds the threshold (S33: YES), the CPU 181 sets the initial value (that is, the maximum value within the settable range) as the rotation speed N, in order to effectively increase the rotational energy to be supplied to the driver 3 (S34).

In a case where the acceleration does not exceed the threshold (S33: NO), the CPU 181 sets the rotation speed N which is associated with the rotation speed N1 and the rotation speed N2 with reference to the table 187 (S35). In S34 or S35, the rotation speed N stored at this point of time in the RAM 183 is replaced with a newly set rotation speed N. The CPU 181 lights the LEDs of the speed display part 116 according to the rotation speed N of the motor 2 which is set in S34 or S35 (S36).

The CPU 181 determines whether or not the standby-cancel instruction is inputted (S37). Further, the standby-cancel instruction as used herein corresponds to turning off of the trigger switch 141. In a case where the standby-cancel instruction is inputted (S37: YES), the CPU 181 continues to monitor until the standby instruction is inputted (S39: NO, S41: NO, S39) before a specified time elapses after input of the standby-cancel instruction. The specified time adopted in S39 may be the same as or different from that in S17. In the present embodiment, it is set to the same 5 seconds as in S17.

In a case where the specified time elapses without input of the standby instruction (S39: YES), the CPU 181 returns to the processing of S11 in FIG. 9 and sets the rotation speed N to the initial value. In other words, in a case where the standby state is cancelled after the driving operation and a new standby instruction is not inputted for the specified time, the setting of the rotation speed N of the motor 2 is returned to the maximum speed. The subsequent processing is executed as described above.

In a case where the standby instruction is inputted within the specified time (S39: NO, S41: YES), the CPU 181 returns to the processing of S15 in FIG. 9 and starts driving of the motor 2. At this time, the CPU 181 controls the rotation speed of the rotor of the motor 2 to become the rotation speed N which is set in S34 or S35 after the previous driving operation and stored in the RAM 183. The subsequent processing is executed as described above.

In a case where the CPU 181 determines that the trigger switch 141 is held in the on-state and the standby-cancel instruction is not inputted (S37: NO), the CPU 181 starts driving of the motor 2 at the rotation speed N which is set in S34 or S35 after the previous driving operation and stored in the RAM 183 (S43). This processing is provided so that the rotational energy can be stored in the flywheel 4 until an actuation instruction is inputted, as described above. The CPU 181 continues to monitor until an actuation instruction is inputted before a specified time elapses after start of driving of the motor 2 (S45: NO, S49: NO, S45). The specified time adopted in S45 may be the same as or different from that in S17 and S39. In the present embodiment, it is set to the same 5 seconds as in S17 and S39. In a case where the specified time elapses without input of the actuation instruction (S45: YES), the CPU 181 stops driving of the motor 2 and returns to the processing of S11 in FIG. 9 to set the rotation speed N to the initial value. In other words, in a case where a new actuation instruction is not inputted for the specified time while being kept in the standby state after the driving operation, the setting of the rotation speed N of the motor 2 is returned to the maximum speed. The subsequent processing is executed as described above.

In a case where the actuation instruction is inputted within the specified time (S45: NO, S49: YES), the CPU 181 returns to S25 to detect the rotation speed N1 of the motor 2 before the driving operation and stops driving of the motor 2 (S27), and then actuates the solenoid 715 to cause the driver 3 to perform the driving operation (S29). In other words, in a case where a new actuation instruction is inputted while being kept in the standby state after the driving operation, the next driving operation is immediately performed at the rotation speed N which is appropriately set based on the previous driving operation.

Figure 14:
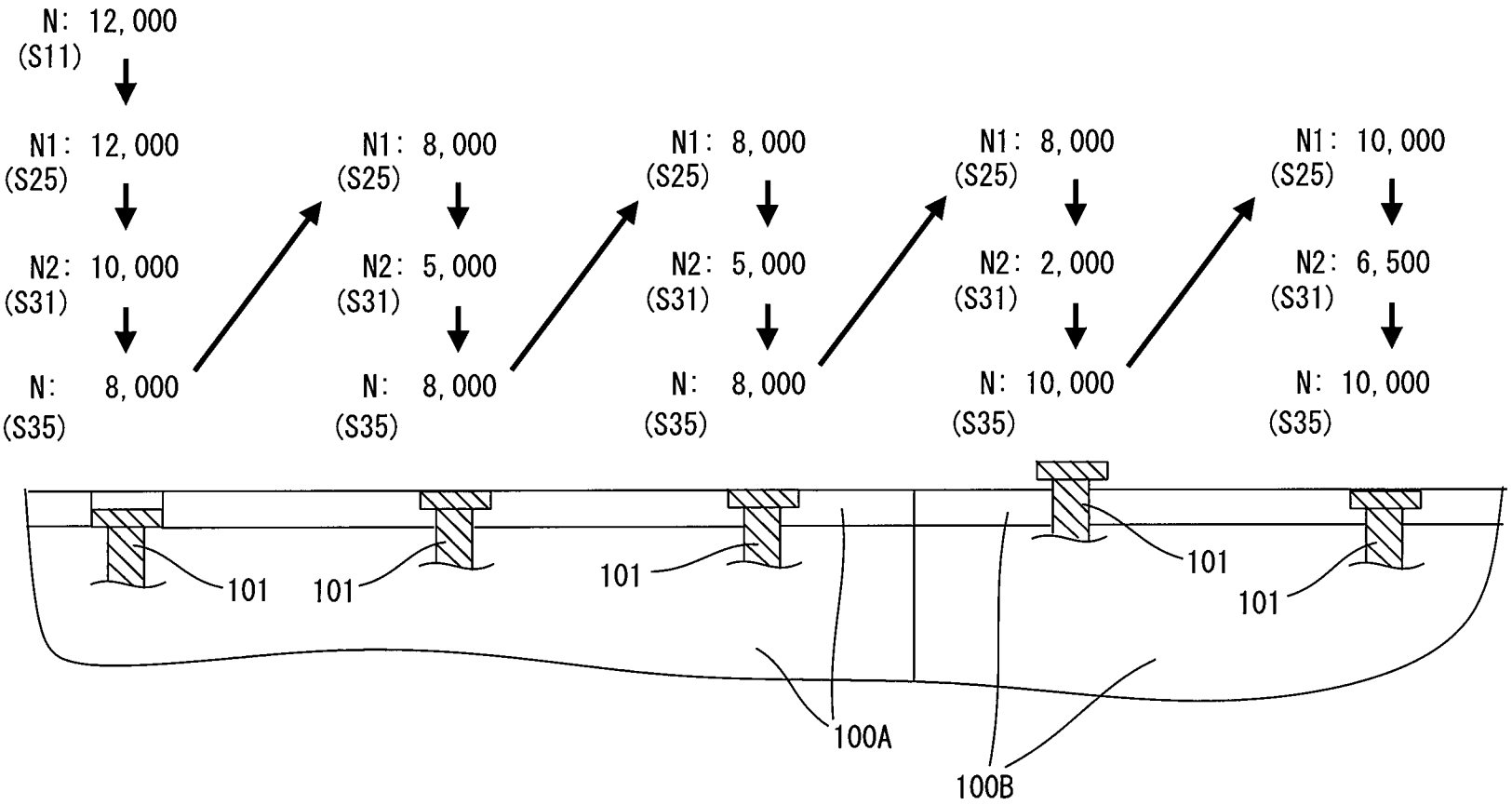
FIG. 14 is an explanatory drawing for illustrating a specific application of the driving control processing.

A specific application example of the driving control processing (see FIGS. 9 and 10) described above is now described with reference to FIG. 14. As shown in FIG. 14, firstly, the initial value of the rotation speed N is set to the maximum speed of 12,000 rpm (S11). In a case where the rotation speeds N1 and N2 which are detected before and after a first driving operation are respectively 12,000 rpm and 10,000 rpm (S25, S31), it indicates an excessive driven state in which the head of the nail 101 is buried in the workpiece 100A. Accordingly, the rotation speed N for the next driving operation is set to a lower speed of 8,000 rpm, with reference to the table 187 (see FIG. 8) (S35). As a result, the rotation speeds N1 and N2 for a second driving operation decrease to 8,000 rpm and 5,000 rpm, respectively (S25, S31), so that a proper driven state can be realized in which the head of the nail 101 is substantially flush with the surface of the workpiece 100A. In this case, the rotation speed N for the next driving operation is set to the same 8,000 rpm as in the previous driving operation, with reference to the table 187 (S35). In a third driving operation, the proper driven state can also be realized and the rotation speed N is set to the same 8,000 rpm as in the previous driving operation (S35).

In a case where a fourth driving operation is performed on a workpiece 100B which is harder than the workpiece 100A at the set rotation speed N of 8,000 rpm, and the rotation speeds N1 and N2 are respectively 8,000 rpm and 2,000 rpm (S25, S31), it indicates an insufficient driven state in which the head of the nail 101 protrudes from the surface of the workpiece 100B. Accordingly, the rotation speed N for the next driving operation is set to a higher speed of 10,000 rpm, with reference to the table 187 (S35). As a result, the rotation speeds N1 and N2 for a fifth driving operation increase to 10,000 rpm and 6,500 rpm, respectively (S25, S31), so that a proper driven state can be realized.

As described above, in the present embodiment, the CPU 181 sets the rotation speed N of the motor 2 based on the rotation speed N1 of the motor 2 as the information corresponding to the pre-driving energy and the rotation speed N2 of the motor 2 as the information corresponding to the post-driving energy. More specifically, the CPU 181 sets the rotation speed N of the motor 2, with reference to the table 187 stored in the ROM 182. In the table 187, the rotation speed N1, the range of the rotation speed N2 and the rotation speed N are associated with each other based on the correspondences between the rotational energy of the flywheel 4 before a driving operation and the energy consumption by the driving operation which are actually measured, and the corresponding actual state of the nail 101 driven into the workpiece 100. The CPU 181 can easily set the rotation speed N with reference to the table 187 and properly control the rotational energy to be supplied to the driver 3 in the next driving operation to thereby realize a proper driven state.

In other words, in the nailing machine 1 of the present embodiment, the CPU 181 automatically can set an appropriate rotation speed N for the next driving operation every time a driving operation is performed. Thus, a user need not manually set the rotation speed of the motor while checking the driven state of the nail, so that the working efficiency can be improved. In addition, an operation member for manually setting the rotation speed of the motor 2 is not required, so that an extra cost increase can be prevented. Further, for example, the need for setting the rotation speed of the motor to be excessively high in order to prevent insufficient driving can be eliminated, which may also contribute to protection of the motor 2 and the front stopper parts 117, suppression of power consumption and shortening of a start-up time. Particularly, by suppression of power consumption, the nailing machine 1, which is powered by the rechargeable battery 119, can increase the number of the nails 101 which can be driven on a single charge and thus improve working efficiency.

Further, in the present embodiment, in a case where the rotation speed N2 of the motor 2 after a driving operation is smaller than a specified threshold which corresponds to the rotation speed N1 of the motor 2 before the driving operation, the rotation speed N of the motor 2 is set to the maximum speed. Similarly, in a case where a specified time elapses without a next driving operation being performed after a driving operation, the rotation speed N of the motor 2 is also set to the maximum speed. Further, in a case where the acceleration detected by the acceleration sensor 115 exceeds a specified threshold, the rotation speed N of the motor 2 is also set to the maximum speed. All of these cases are considered to correspond to a significantly insufficient driven state. Therefore, shortage of the rotational energy to be supplied to the driver 3 in the next driving operation can be reliably prevented by setting the rotation speed N of the motor 2 to a maximum value within the settable range.

The above-described embodiment is a mere example and a driving tool according to the present disclosure is not limited to the structure of the nailing machine 1 of the above-described embodiment. For example, the following modifications or changes may be made. Further, one or more of these modifications may be employed in combination with the nailing machine 1 of the above-described embodiment or the claimed invention.

The driving tool may be a tool for driving out a fastener other than the nail 101. For example, the driving tool may be embodied as a tacker or a staple gun which drives out a rivet, pin or staple. Further, the driving source of the flywheel 4 is not particularly limited to the motor 2. For example, an alternate current (AC) motor may be employed in place of the DC motor.

The CPU 181 may set the rotation speed N for a specified number of times of the next driving operations every time the specified number of times of the driving operations are performed, instead of setting it for each driving operation. In this case, the rotation speed N may be set based on, for example, an average value of the rotation speed N2.

As the information corresponding to the pre-driving energy and the information corresponding to the post-driving energy, for example, the rotation speeds of the flywheel 4 which are respectively detected before and after a driving operation may be employed, in place of the rotation speeds N1 and N2 of the motor 2. In this case, the rotation speed of the flywheel 4 may be detected, for example, by using a Hall sensor like in the above-described embodiment. The rotation speed of the motor 2 or the flywheel 4 may be detected by a sensor (such as an optical sensor and a contact type sensor) other than the Hall sensor.

Numerical values of the table 187 shown in FIG. 8 are mere examples for explaining the correspondences between the rotation speed N1, the rotation speed N2 and the rotation speed N. Therefore, as a matter of course, proper numerical values may be appropriately employed according to the specifications of the flywheel 4, for example. Further, the correspondences between the rotation speed N1, the rotation speed N2 and the rotation speed N may be stored in a form other than the table 187. Further, the table 187 may be stored in a nonvolatile memory if the nailing machine 1 includes a nonvolatile memory, or in an external, computer-readable storage medium (such as an SD card and a USB memory). The rotation speed N need not necessarily be set with reference to the correspondences stored in advance in the table 187 or the like, and may be calculated based on information corresponding to the pre-driving energy and information corresponding to the post-driving energy every time a driving operation is performed.

In the above-described embodiment, turning on both the contact arm switch 131 and the trigger switch 141 regardless of the order is defined as conditions for starting a driving operation. However, the order of turning on the two switches may be defined as the conditions for starting a driving operation. Further, a plurality of operation modes which are different in conditions for starting a driving operation may be provided and the CPU 181 may determine whether to start the driving operation according to one of the modes which is selected by a user.

In the above-described embodiment, the CPU 181 sets the rotation speed N based on not only the information corresponding to the pre-driving energy and the information corresponding to the post-driving energy, but also the detection result of the acceleration sensor 115. However, the acceleration sensor 115 may be omitted.

The method of indicating to a user the rotation speed N which is automatically set by the CPU 181 is not limited to the speed display part 116 including the LEDs, but any method may be adopted. For example, a numerical value indicating the rotation speed N may be displayed on a liquid crystal display (LCD), or it may be indicated by sound such as a buzzer. Information relating to a driving condition of the motor 2 which is different from the rotation speed N may be indicated. For example, change of the rotation speed N may be indicated by blinking of the LEDs. Further, for example, in a case where the rotation speed N2 of the motor 2 after a driving operation is smaller than a threshold, in a case where a specified time elapses without a next driving operation being performed after a driving operation, or in a case where the acceleration exceeds a specified threshold, an indication that the rotation speed N of the motor 2 has been reset to the maximum speed may be made by lighting of the LEDs having a color different from that in a normal indication of the rotation speed N. Moreover, not only the driving condition of the motor 2 but also other information relating to the operation state of the nailing machine 1 may be indicated. For example, information corresponding to the detection result of the acceleration sensor 115 (for example, the fact that the acceleration exceeds the threshold) may be indicated. Further, indication of such information need not necessarily be performed.

In the above-described embodiment, as an example, the controller 18 is formed by a microcomputer including the CPU 181, but it may be formed by a programmable logic device such as ASIC (Application Specific Integrated Circuits) and FPGA (Field Programmable Gate Array). Further, in order to realize the driving control processing of the above-described embodiment, the CPU 181 may execute a program stored in the ROM 182. In a case where the nailing machine 1 includes a nonvolatile memory, the program may be stored in the nonvolatile memory. Alternatively, the program may be stored in an external, computer-readable storage medium (such as an SD card and a USB memory). The driving control processing of the above-described embodiment and its modifications may be distributed to a plurality of control circuits.

The shape of the driver 3 and the structure of the driver-driving mechanism 400 for driving the driver 3 may be appropriately changed. For example, in each of the roller-abutting parts 301 of the driver 3, the inclined part 302 may have a linear shape as a whole or have a gentle circular arc shape at least in part when viewed from the side. Specifically, the upper surface (the contact surface with the pressing roller 83) of the inclined part 302 may be a flat or curved surface as a whole, or may by partially flat and partially curved. Further, the degree of inclination of the inclined part 302 may be changed in the middle. The inclined part 302 may be formed longer. Each of the roller-abutting part 301 may include a plurality of inclined parts each having a thickness gradually increasing toward the rear. Further, in place of the driver-driving mechanism 400, a driving mechanism may be adopted which is configured to directly transmit rotational energy from the flywheel 4 to the driver 3 by frictionally engaging the driver 3 with the flywheel 4, without using the ring members 5. The rotational energy of the flywheel 4 may be transmitted to the driver 3 via a transmitting member (for example, an intermediate roller) which is different from the ring members 5.

Engagement of the ring members 5 with the driver 3 and the flywheel 4 is not limited to the engagement exemplified in the above-described embodiment. For example, the number of the ring members 5 and the numbers of the engagement grooves 308 of the driver 3 and the engagement grooves 47 of the flywheel 4 which correspond to the ring members 5 may be one, or three or more. Further, for example, the shapes, arrangements, numbers and engaging positions of the outer peripheral engagement part 51 and the inner peripheral engagement part 53 and the corresponding engagement grooves 308 and 47 may be appropriately changed.

The structure of the actuating mechanism 7 may be appropriately changed or modified, as long as the actuating mechanism 7 is configured to move the driver 3 from the initial state in which the driver 3 is placed in the initial position to a state in which the rotational energy of the flywheel 4 can be transmitted to the driver 3. For example, the actuating mechanism 7 may be configured such that the flywheel 4 and the driver 3 are frictionally engaged with each other directly or indirectly (for example, via the ring members 5) by biasing the driver 3 placed in the initial position toward the flywheel 4, instead of by pushing out the driver 3 forward toward the transmitting position.

Correspondences between the features of the embodiment and the features of the invention are as follows. The nailing machine 1 is an example that corresponds to the "driving tool". The nail 101 is an example that corresponds to the "fastener". The outlet 123 is an example that corresponds to the "outlet". The motor 2 is an example that corresponds to the "motor". The flywheel 4 is an example that corresponds to the "flywheel". The driver 3 is an example that corresponds to the "driver". The operation line L is an example that corresponds to the "operation line". The CPU 181 is an example that corresponds to the "control part". The rotation speeds N1 and N2 are examples that correspond to the "first information" and the "second information", respectively. The ROM 182 is an example that corresponds to the "storage part". The Hall sensor 203 is an example that corresponds to the "first sensor". The acceleration sensor 115 is an example that corresponds to the "second sensor". The speed display part 116 is an example that corresponds to the "indication part".

In view of the nature of the present disclosure and the above-described embodiment, the following features (aspects) are provided. One or more of the following features may be employed separately or in combination with any one of the nailing machine 1 of the above-described embodiment and modification thereto, and the claimed invention.

(Aspect 1)

The first information, the second information and the rotation speed of the motor are associated with each other and stored in a table in advance, and the table is stored in a storage part, and the control part is configured to set the rotation speed with reference to the table.

(Aspect 2)

The motor is a brushless motor, and the first sensor comprises a Hall sensor configured to detect a rotation position of the motor.

(Aspect 3)

The driving tool further comprises a battery mounting part to which a rechargeable battery is removably mounted.

(Aspect 4)

The second sensor is provided in a tool body which houses at least the motor and the flywheel, or in a handle connected to the tool body.

(Aspect 5)

The second sensor is an acceleration sensor, and the control part is configured to set the rotation speed of the motor to a maximum value within a settable range in a case where the acceleration exceeds a specified threshold.

DESCRIPTION OF NUMERALS

1: nailing machine, 10: tool body, 11: body housing, 115: acceleration sensor, 116: speed display part, 117: front stopper part, 118: rear stopper part, 12: nose part, 123: outlet, 13: contact arm, 131: contact arm switch, 14: handle, 140: trigger, 141: trigger switch, 15: battery mounting part, 17: magazine, 18: controller, 180: board, 181: CPU, 182: ROM, 183: RAM, 184: timer, 187: table, 19: battery, 2: motor, 201: three-phase inverter, 203: Hall sensor, 21: pulley, 25: belt, 3: driver, 30: body, 301: roller-abutting part, 302: inclined part, 305: lever-abutting part, 306: ring-engagement part, 307: inclined part, 308: engagement groove, 310: front end, 31: striking part, 32: rear end, 35: arm part, 400: driver-driving mechanism, 4: flywheel, 41: pulley, 45: outer periphery, 47: engagement groove, 5: ring member, 51: outer peripheral engagement part, 53: inner peripheral engagement part, 6: holding mechanism, 60: ring-biasing part, 66: stopper, 7: actuating mechanism, 711: push-out lever, 715: solenoid, 8: pressing mechanism, 81: roller support member, 83: pressing roller, 85: holder, 87: elastic member, 100, 100A, 100B: workpiece, 101: nail, A1: rotation axis, A2: rotation axis

What is claimed is:

1. A driving tool configured to eject a fastener from an outlet to drive the fastener into a workpiece, the driving tool comprising:

a motor;

a flywheel configured to be rotationally driven by the motor;

a driver disposed to face an outer periphery of the flywheel and configured to perform a driving operation of driving the fastener into the workpiece by moving along an operation line, by rotational energy transmitted from the flywheel; and a control part configured to control driving of the motor, wherein:

the control part is configured to set rotation speed of the motor for a subsequent driving operation of the driver based on first information and second information of the driving operation, the first information corresponding to rotational energy of the flywheel immediately before the driving operation of the driver and the second information corresponding to rotational energy of the flywheel immediately after the driving operation of the driver.

2. The driving tool as defined in claim 1, wherein the control part is configured to set the rotation speed of the motor with reference to correspondences between the first information, the second information and the rotation speed of the motor which are preset and stored in a storage part.

3. The driving tool as defined in claim 2, wherein:

the first information, the second information and the rotation speed of the motor are associated with each other and stored in a table in advance, the table is stored in the storage part, and the control part is configured to set the rotation speed with reference to the table.

4. The driving tool as defined in claim 1, further comprising:

a first sensor configured to detect rotation speed of the motor or the flywheel, wherein:

the first information is rotation speed of the motor or the flywheel detected by the first sensor before the driving operation, and the second information is rotation speed of the motor or the flywheel detected by the first sensor after the driving operation.

5. The driving tool as defined in claim 4, wherein:

the motor is a brushless motor, and the first sensor comprises a Hall sensor configured to detect a rotation position of the motor.

6. The driving tool as defined in claim 4, wherein the control part is configured to set the rotation speed of the motor to a maximum value within a settable range in a case where the rotation speed of the motor or the flywheel detected after the driving operation is smaller than a specified threshold.

7. The driving tool as defined in claim 1, wherein the control part is configured to set the rotation speed of the motor to a maximum value within a settable range in a case where a specified time elapses without a next driving operation being performed after a driving operation.

8. The driving tool as defined in claim 1, further comprising:

a second sensor configured to detect information corresponding to movement of the driving tool caused by the driving operation, wherein:

the control part is configured to set the rotation speed of the motor based on a detection result of the second sensor.

9. The driving tool as defined in claim 8, wherein the second sensor is provided in a tool body which houses at least the motor and the flywheel, or in a handle connected to the tool body.

10. The driving tool as defined in claim 8, wherein:

the second sensor is an acceleration sensor, and the control part is configured to set the rotation speed of the motor to a maximum value within a settable range in a case where the acceleration exceeds a specified threshold.

11. The driving tool as defined in claim 1, further comprising an indication part configured to indicate information relating to a condition of driving the motor by the control part.

12. The driving tool as defined in claim 1, further comprising a battery mounting part configured to removably receive a rechargeable battery.

* * * * *